US012221847B2

(12) United States Patent
Painter

(10) Patent No.: US 12,221,847 B2
(45) Date of Patent: Feb. 11, 2025

(54) TUBING HANGER RETENTION SYSTEMS FOR WELLHEAD ASSEMBLIES

(71) Applicant: Chevron U.S.A. Inc., San Ramon, CA (US)

(72) Inventor: Jay Patrick Painter, League City, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/459,710

(22) Filed: Sep. 1, 2023

(65) Prior Publication Data

US 2024/0093564 A1 Mar. 21, 2024

Related U.S. Application Data

(60) Provisional application No. 63/408,500, filed on Sep. 21, 2022.

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS 2,178,549 A * 11/1939 Block ..... E21B 33/04 285/123.9
4,919,459 A * 4/1990 Miller ..... F16J 15/18 285/123.8
2016/0326824 A1* 11/2016 Lugtmeier ..... E21B 33/04
2020/0123864 A1* 4/2020 Scott ..... E21B 33/04
2024/0018841 A1* 1/2024 Hult ..... E21B 33/0415

* cited by examiner

*Primary Examiner* — James G Sayre
(74) *Attorney, Agent, or Firm* — Smith & Woldesenbet Law Group, PLLC

(57) ABSTRACT

A tubing hanger retention system for a wellhead assembly can include a retention ring that is configured to fit over a top portion of a tubing hanger of the wellhead assembly, where the retention ring comprises a plurality of retention ring channels. The tubing hanger retention system can also include multiple retention pin receiving features configured to be disposed, at least in part, within multiple tubing spool channels of a tubing spool. The tubing hanger retention system can further include multiple retention pins configured to be received by the retention pin receiving features, where each retention pin includes an engagement feature configured to be received by a retention pin receiving feature to place the retention pin in a captured state, where the engagement feature of each retention pin is further configured to enter into an engaged state with a retention ring channel when the retention pin is moved inward.

20 Claims, 9 Drawing Sheets

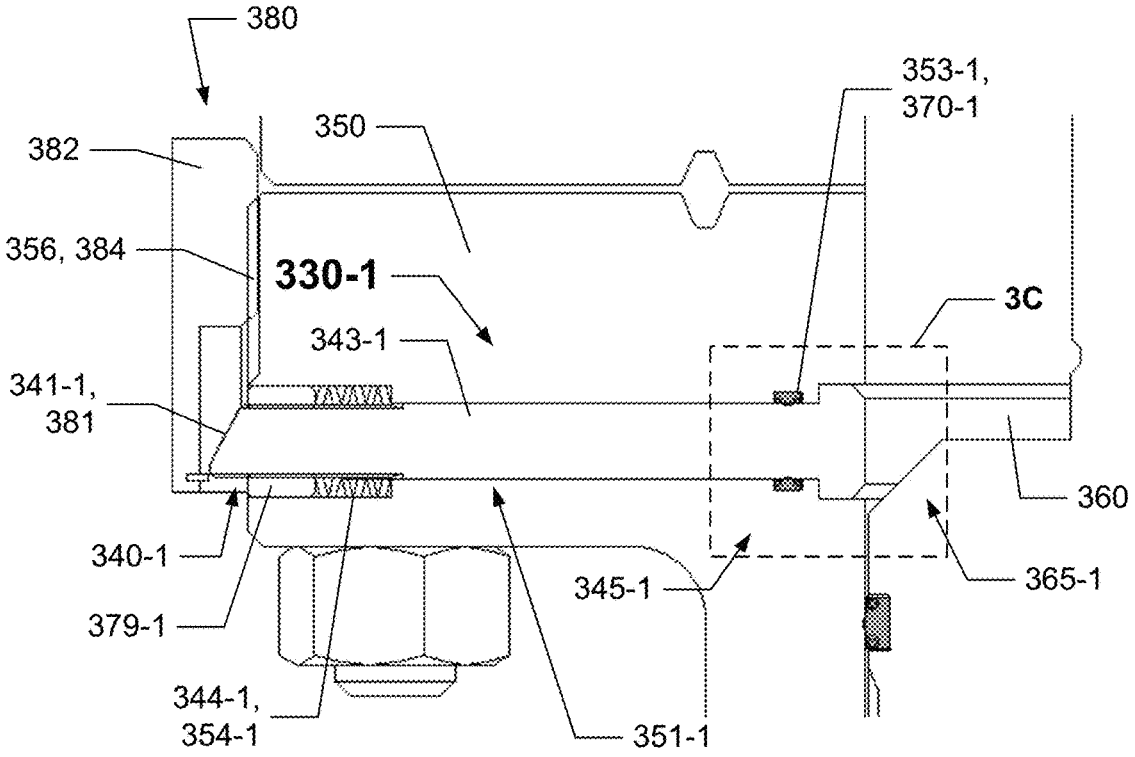
FIG. 3B
FIG. 3C
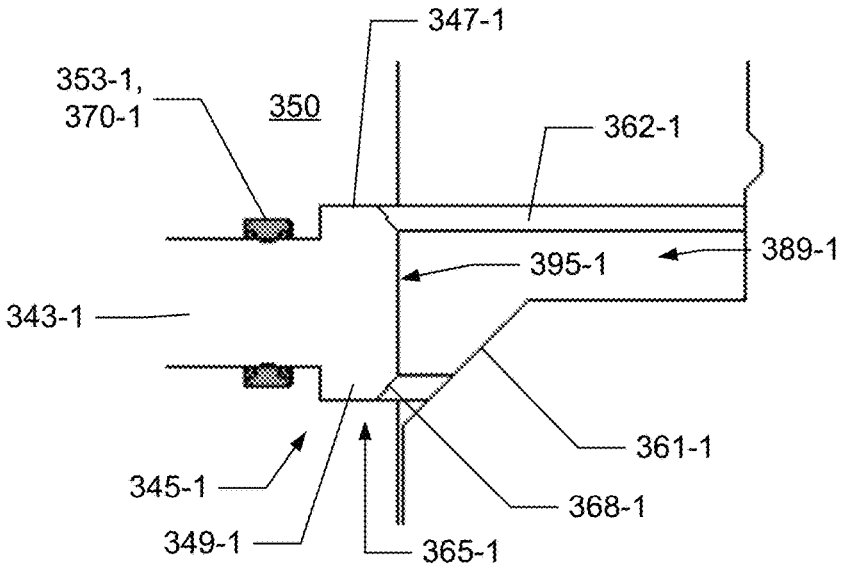

TUBING HANGER RETENTION SYSTEMS FOR WELLHEAD ASSEMBLIES

CROSS-REFERENCE TO RELATED APPLICATIONS

This application claims priority under 35 U.S.C. § 119 to U.S. Provisional Patent Application Ser. No. 63/408,500, titled "Tubing Hanger Retention Systems For Wellhead Assemblies" and filed on Sep. 21, 2022, the entire contents of which are hereby incorporated herein by reference.

TECHNICAL FIELD

The present application is related to wellheads and, more particularly, to a mandrel retention system for a wellhead assembly.

BACKGROUND

Lockdown screws are used to lock down hangers and/or energize seals within a wellhead assembly. Lockdown screws are body penetrations that are manipulated often under pressure and exposed to wellbore pressure. In the current art, lockdown screws are effectively secured in place using unique and often proprietary locking/unlocking tools that are not externally engageable with the lockdown screws. Internal securing mechanisms for lockdown screws are used in the current art to reduce the risk that the lockdown screws become disengaged and are ejected as projectiles. However, the internal securing mechanisms of the lockdown screws used in the current art makes installation and removal of the lockdown screws cumbersome.

SUMMARY

In general, in one aspect, the disclosure relates to a tubing hanger retention system for a wellhead assembly. The tubing hanger retention system can include a retention ring that is configured to fit over a top portion of a tubing hanger of the wellhead assembly, where the retention ring includes a plurality of retention ring channels. The tubing hanger retention system can also include a plurality of retention pin receiving features configured to be disposed, at least in part, within a plurality of tubing spool channels of a tubing spool of the wellhead assembly. The tubing hanger retention system can further include a plurality of retention pins configured to be received by the plurality of retention pin receiving features, where each retention pin of the plurality of retention pins comprises a distal end, where the distal end of each retention pin includes an engagement feature that is configured to be received by one of the plurality of retention pin receiving features to place the retention pin in a captured state within the tubing spool channel, where the engagement feature of each retention pin, after being received by the retention pin receiving feature, is configured to enter into an engaged state with one of the plurality of retention ring channels when the retention pin is moved inward within the tubing spool channel toward the retention ring, and where the engagement feature of the retention pin is further configured to remain in the captured state until after the tubing spool is removed from a reminder of the wellhead assembly.

In another aspect, the disclosure relates to a wellhead assembly. The wellhead assembly can include a tubing hanger and a tubing spool coupled to and disposed over the tubing hanger, where the tubing spool has a plurality of tubing spool channels disposed therethrough. The wellhead assembly can also include a tubing hanger retention system coupled to the tubing spool, where the tubing hanger retention system includes a retention ring disposed over a top portion of the tubing hanger, where the retention ring includes a plurality of retention ring channels. The tubing hanger retention system can also include a plurality of retention pin receiving features disposed, at least in part, at a distal end of the tubing spool channels. The tubing hanger retention system can further include a plurality of retention pins received by the plurality of retention pin receiving features, where each retention pin of the plurality of retention pins includes a distal end, where the distal end of each retention pin comprises an engagement feature that is received by one of the plurality of retention pin receiving features to place the retention pin in a captured state within the tubing spool channel, where the engagement feature of each retention pin, after being received by the retention pin receiving feature, enters into an engaged state when the retention pin is moved inward within the tubing spool channel toward the retention ring channel, and where the engagement feature of the retention pin remains in the captured state until after the tubing spool is removed from a reminder of the wellhead assembly.

In yet another aspect, the disclosure relates to a method for securing retention pins in a wellhead assembly. The method can include moving, using a retention pin driver, a plurality of retention pins inward within a plurality of tubing spool channels in a tubing spool of the wellhead assembly, where a distal end of each of the plurality of retention pins includes an engagement feature that is captured by a retention pin receiving feature disposed in each of the plurality of tubing spool channels, where propelling the plurality of retention pins inward engages the engagement feature of each retention pin with one of the plurality of retention ring channels of the retention ring, and where the engagement feature of each retention pin remains captured by one of the plurality of retention pin engagement features until after the tubing spool is removed from a reminder of the wellhead assembly.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

FIGS. 3A through 3C show various views of another wellhead assembly that includes a tubing hanger retention system with retention pins in a captured position according to certain example embodiments.

DETAILED DESCRIPTION

Figure 1:
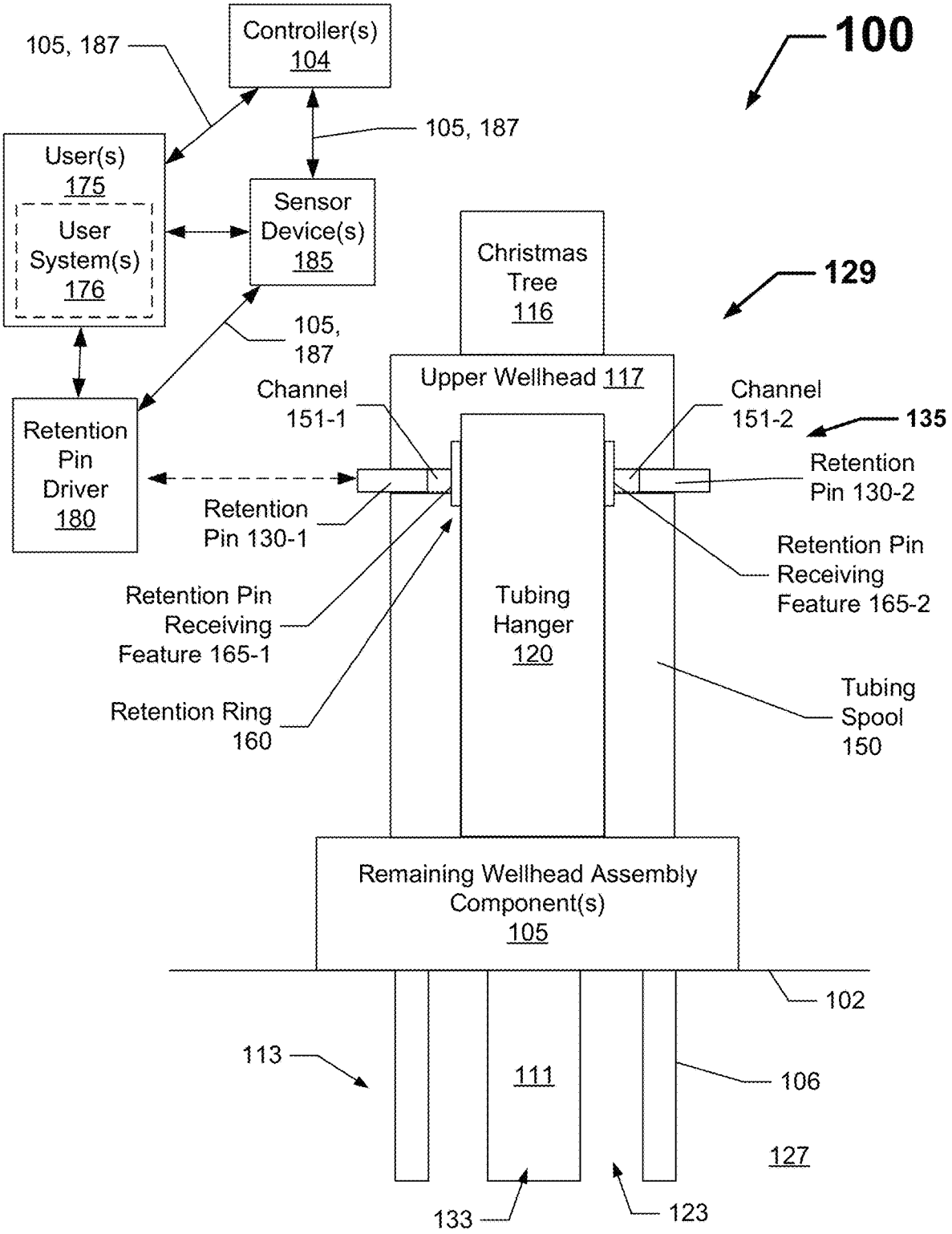
FIG. 1 shows a system that includes a wellhead assembly according to certain example embodiments.

The example embodiments discussed herein are directed to systems, apparatus, methods, and devices for tubing hanger retention systems for wellhead assemblies. Example embodiments can be used in wellhead assemblies for subterranean field operations (e.g., injection operations, production operations). Example embodiments can be used for wellhead assemblies in both land-based and offshore subterranean operations. While example embodiments are described as being used in conjunction with tubing hangers herein, example embodiments can be used, in full or in part, in conjunction with other components (e.g., a casing hanger) of a wellhead assembly.

A wellhead assembly that includes example tubing hanger retention systems can include one or multiple components, where a component can be made from a single piece (as from a mold or an extrusion or a three-dimensional printing process). When a component (or portion thereof) of a wellhead assembly that includes example tubing hanger retention systems is made from a single piece, the single piece can be cut out, bent, stamped, and/or otherwise shaped to create certain features, elements, or other portions of the component. Alternatively, a component (or portion thereof) of a wellhead assembly that includes example tubing hanger retention systems can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, rotatably, removably, slidably, and threadably.

Wellhead assemblies that include example tubing hanger retention systems can be designed to comply with certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA). Each component of a wellhead assembly (including portions thereof) can be made of one or more of a number of suitable materials, including but not limited to metal (e.g., stainless steel), ceramic, rubber, glass, fibrous material, and plastic.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of tubing hanger retention systems for wellhead assemblies will be described more fully hereinafter with reference to the accompanying drawings, in which example embodiments of tubing hanger retention systems for wellhead assemblies are shown. Tubing hanger retention systems for wellhead assemblies may, however, be embodied in many different forms and should not be construed as limited to the example embodiments set forth herein. Rather, these example embodiments are provided so that this disclosure will be thorough and complete, and will fully convey the scope of tubing hanger retention systems for wellhead assemblies to those of ordinary skill in the art. Like, but not necessarily the same, elements (also sometimes called components) in the various figures are denoted by like reference numerals for consistency.

Terms such as "first", "second", "outer", "inner", "top", "bottom", "above", "below", "distal", "proximal", "front,", "rear," "left," "right," "on", and "within", when present, are used merely to distinguish one component (or part of a component or state of a component) from another. This list of terms is not exclusive. Such terms are not meant to denote a preference or a particular orientation, and they are not meant to limit embodiments of tubing hanger retention systems for wellhead assemblies. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a system 100 that includes a wellhead assembly 129 according to certain example embodiments. The system 100 includes multiple components. For example, as shown in FIG. 1, the system 100 can include the wellhead assembly 129, a Christmas tree 116 mounted atop the wellhead assembly 129, a wellbore 113 in a subterranean formation 127, one or more controllers 104, one or more sensor devices 185, and one or more users 175, which can each include one or more user systems 176. The wellhead assembly 129 of the system 100 can include an upper wellhead 117, a tubing hanger 120, a tubing spool 150, a tubing hanger retention system 135, and one or more of a number of remaining wellhead assembly components 105. Examples of the remaining wellhead assembly components 105 can include, but are not limited to, a valve, a sensor device, piping, a casing spool, and a casing hanger. The wellbore 113 has a production casing 106, inside of which is positioned a tubing string 111. The tubing string 111 has a cavity 133 that extends continuously along its length, and there is an annulus 123 between the tubing string 111 and the production casing 106 that extends continuously along its length.

The components shown in the system 100 of FIG. 1 are not exhaustive, and in some embodiments, one or more of the components shown in FIG. 1 may not be included in a wellhead assembly 129 in which an example tubing hanger retention system 135 can be used. Any component of the wellhead assembly 129 can be discrete or combined with one or more other components of the wellhead assembly 129. Also, one or more components of the wellhead assembly 129 can have different configurations.

A user 175 can be any person that interacts, directly or indirectly, with a controller 104, a sensor device 185, the retention pin driver 180, and/or any other component of the system 100. Examples of a user 175 may include, but are not limited to, a company representative, an engineer, a geologist, a consultant, a contractor, and a manufacturer's representative. A user 175 can use one or more user systems 176, which may include a display (e.g., a GUI). A user system 176 of a user 175 can interact with (e.g., send data to, obtain data from) a controller 104, a sensor device 185, and/or the retention pin driver 180 via an application interface and using the communication links 105.

A user 175 can also interact directly with a controller 104, a sensor device 185, and/or the retention pin driver 180 through a user interface (e.g., keyboard, mouse, touchscreen). A user system 176 of a user 175 can interact with (e.g., sends data to, receives data from) a controller 104, a sensor device 185, and/or the retention pin driver 180 via an application interface. Examples of a user system 176 can include, but are not limited to, a cell phone with an app, a laptop computer, a handheld device, a smart watch, a desktop computer, and an electronic tablet.

The system 100 can include one or more controllers 104. A controller 104 of the system 100 communicates with and in some cases controls one or more of the other components (e.g., a sensor device 185, the retention pin driver 180) of the system 100. A controller 104 performs a number of functions that include obtaining and sending data, evaluating data, following protocols, running algorithms, and sending commands. A controller 104 can include one or more of a number of components. Such components of a controller 104 can include, but are not limited to, a control engine, a communication module, a timer, a counter, a power module, a storage repository, a hardware processor, memory, a transceiver, an application interface, and a security module. When there are multiple controllers 104 in the system 100, each controller 104 can operate independently of each other. Alternatively, one or more of the controllers 104 can work cooperatively with each other. As yet another alternative, one of the controllers 104 can control some or all of one or more other controllers 104 in the system 100. In some cases, a controller 104 is an optional component of the system 100.

Each sensor device 185 includes one or more sensors that measure one or more parameters (e.g., pressure, distance, torque, flow rate, temperature, humidity, voltage, current). Examples of a sensor of a sensor device 185 can include, but are not limited to, a temperature sensor, torque sensor, a flow sensor, a pressure sensor, a gas spectrometer, a voltmeter, an ammeter, a permeability meter, a porosimeter, and a camera. A sensor device 185 can be integrated with and/or measure a parameter associated with one or more components (e.g., a retention pin 130, the retention pin driver 180, the tubing spool 150) of the system 100. For example, a sensor device 185 can be configured to measure a parameter (e.g., torque, distance) associated with moving a retention pin 130 within a tubing spool channel 151. In some cases, the measurements made by one or more sensor devices 185, each measuring a different parameter, can be used to determine and confirm whether a controller 104 should take a particular action (e.g., operate a valve, operate or adjust the retention pin driver 180). In some cases, a sensor device 185 can include its own controller (e.g., controller 104), or portions thereof. In some cases, a sensor device 185 is an optional component of the system 100.

Each communication link 105 can include wired (e.g., Class 1 electrical cables, electrical connectors, Power Line Carrier, RS485) and/or wireless (e.g., sound or pressure waves in the water 194, Wi-Fi, Zigbee, visible light communication, cellular networking, Bluetooth, Bluetooth Low Energy (BLE), ultrawide band (UWB), WirelessHART, ISA100) technology. A communication link 105 can transmit signals (e.g., communication signals, control signals, data) from one component (e.g., a controller 104) of the system 100 to another (e.g., a valve on the Christmas tree 116, the retention pin driver 180).

Each power transfer link 187 can include one or more electrical conductors, which can be individual or part of one or more electrical cables. In some cases, as with inductive power, power can be transferred wirelessly using power transfer links 187. A power transfer link 187 can transmit power from one component (e.g., a battery, a generator) of the system 100 to another (e.g., a motor of the retention pin driver 180). Each power transfer link 187 can be sized (e.g., 12 gauge, 18 gauge, 4 gauge) in a manner suitable for the amount (e.g., 480V, 24V, 120V) and type (e.g., alternating current, direct current) of power transferred therethrough.

The tubing hanger 120 (also called by other names, including but not limited to the tubing mandrel and the tubing head) of the wellhead assembly 129 is configured to support the tubing string 111. Generally, the tubing hanger 120 is positioned toward the top of the wellhead assembly 129. The tubing hanger 120 can have any of a number of configurations (e.g., mating threads, recesses) and/or components (e.g., pins) to support the tubing string 111 while also incorporating a sealing system to ensure that the cavity 133 within the tubing string 111 and the annulus 123 between the tubing string 111 and the production casing 106 are hydraulically isolated from each other. Once the wellbore 113 is drilled, the production casing 106 is inserted into the wellbore 113 to stabilize the wellbore 113 and allow for the extraction of subterranean resources (e.g., natural gas, oil) from the subterranean formation 127. The production casing 106 is often secured to the subterranean formation 127 using cement injected in an intermediate field operation.

The tubing spool 150 (also called by other names, including but not limited to the wellhead spool) of the wellhead assembly 129 is configured to support the tubing hanger 120, and so indirectly support the tubing string 111. The tubing spool 150 has an inner channel inside of which the tubing hanger 120 is positioned within the wellhead assembly 129. The tubing spool 150 and the tubing hanger 120 can abut against and form a seal between each other.

The upper wellhead 117 is coupled to and is positioned above the tubing spool 150. The tubing hanger 120 is positioned inside of the upper wellhead 117 and the tubing spool 150. The tubing hanger 120 and/or the tubing spool 150 can be coupled, directly or indirectly, to one or more remaining wellhead assembly components 105. Examples of such remaining wellhead assembly components 105 can include, but are not limited to, the tubing string 111, piping, a valve, a casing spool, and a casing hanger. At least one component (e.g., a remaining wellhead assembly component 105) of the wellhead assembly 129 can be positioned at the surface 102. Below the surface 102 is the subterranean formation 127. Within the subterranean formation 127 is one or more (in this case, one) wellbores 113. In some cases, the surface 102 is under water (e.g., a seabed). In such cases, the wellhead assembly 129 can be located in the water.

The tubing hanger retention system 135 of the system 100 of FIG. 1 can include one or more of a number of components. In this example, the tubing hanger retention system 135 includes multiple retention pins 130 (e.g., retention pin 130-1, retention pin 130-2), multiple retention pin receiving features 165 (e.g., retention pin receiving feature 165-1, retention pin receiving feature 165-2), a retention ring 160, and a retention pin driver 180. The retention ring 160 of the tubing hanger retention system 135 is positioned over part (e.g., a top portion) of the outer perimeter of the tubing hanger 120. As discussed below with respect to FIGS. 2A through 4C, the retention ring 160 can include multiple retention ring channels (e.g., retention ring channels 289), where each retention ring channel is configured to receive the distal end of a retention pin 130 and/or part of a retention pin receiving feature 165. In this example, there are two retention ring channels 289 (retention ring channel 289-1 and retention ring channel 289-2).

Each of the retention pins 130 of the tubing hanger retention system 135 is positioned, at least in part, within one of the channels 151 (e.g., channel 151-1, channels 151-2) that traverse the thickness of the tubing spool 150. In this case, the channels 151 (also sometimes called tubing spool channels 151 herein) are located on the tubing spool 150 in such a way that the channels 151 are positioned adjacent to the retention pin receiving features 165 of the retention ring 160 when the tubing spool 150, the retention ring 160 of the tubing hanger retention system 135, and the tubing hanger 120 are assembled in the wellhead assembly 129. Each channel 151 in the tubing spool 150 can have any of a number of cross-sectional shapes (e.g., a circle, a square, an oval, a rectangle). The cross-sectional shape, as well as other characteristics (e.g., the diameter), of each channel 151 is configured to complement the corresponding characteristics of the retention pin 130 that is placed inside of the channel 151. The configuration of one channel 151 can be the same as, or different than, the configuration of one or more of the other channels 151.

The retention pins 130 are configured to be positioned within the channels 151 in the tubing spool 150. The retention pins 130 are also configured to be received by the retention pin receiving features 165 of the retention ring 160. Up until a retention pin 130 is engaged by a corresponding retention pin receiving feature 165 of the retention ring 160, the retention pin 130 can be movably (e.g., slidably, rotatably) disposed within the channel 151. The distal end of each retention pin 130 has an engagement feature that is configured to be captured by a retention pin receiving feature 165 of the retention ring 160. Specifically in this case, the engagement feature at the distal end of retention pin 130-1 is captured by the retention pin receiving feature 165-1 of the retention ring 160, and the engagement feature at the distal end of retention pin 130-2 is captured by the retention pin receiving feature 165-2 of the retention ring 160. Examples of how the retention pins 130 and the retention pin receiving features 165 of the retention ring 160 can be configured are discussed below with respect to FIGS. 2A through 4C.

In some cases, the retention pins 130 are pre-inserted into the channels 151 before the tubing spool 150 is added to the wellhead assembly 129. In alternative embodiments, the retention pins 130 can be inserted into the channels 151 after the tubing spool 150 is added to the wellhead assembly 129. In some cases, a retention pin 130 can be engaged by a retention pin receiving feature 165 of the retention ring 160 independently of when the other retention pins 130 are engaged by the other retention pin receiving features 165 of the retention ring 160. Alternatively, two or more of the retention pins 130 can be engaged by a retention pin receiving feature 165 of the retention ring 160 substantially simultaneously.

The retention pin driver 180 of the tubing hanger retention system 135 is a separate component that is configured to move the retention pins 130 within the channels 151 of the tubing spool 150. The retention pin driver 180 can move the retention pins 130 inward with respect to the channels 151. The inward movement can transition the status of the retention pins 130, coupled to the retention pin receiving features 165 of the retention ring 160, from a captured state to an engaged state. In some cases, the retention pin driver 180 can move the retention pins 130 inward to abut against the retention ring 160.

The retention pin driver 180 can have any of a number of configurations. Such configurations are designed to complement the configurations of the proximal end of the retention pins 130. For example, the retention pin driver 180 can be or include an automated rotary machine (e.g., a power nut driver, a power screw driver) that is capable of producing a controlled and high amount of torque to a feature and/or outer surface of the proximal end of the retention pins 130 that complements the configuration of the portion of the retention pin driver 180 that engages the proximal end of the retention pins 130.

Figure 3A:
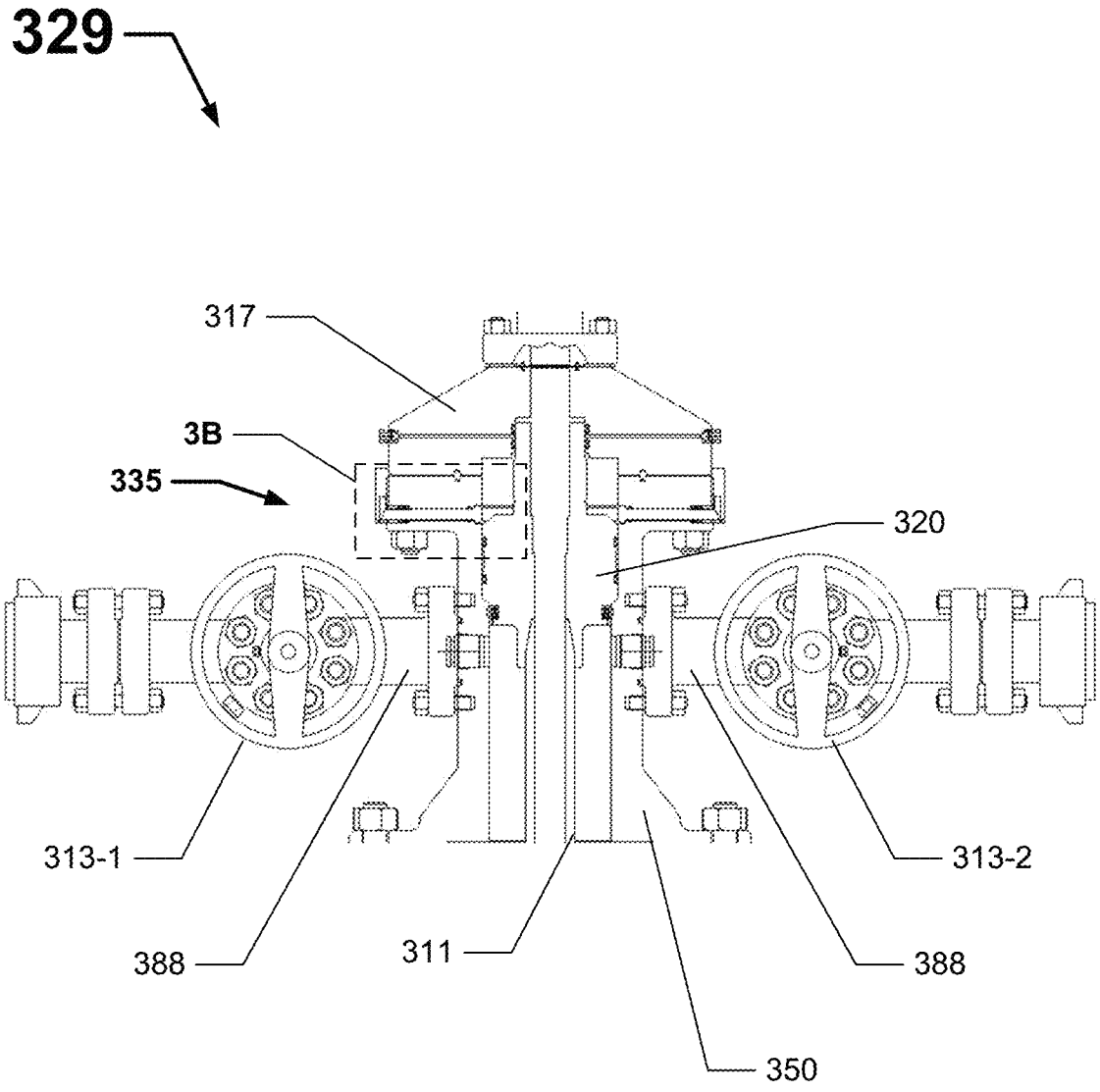
Figure 4A:
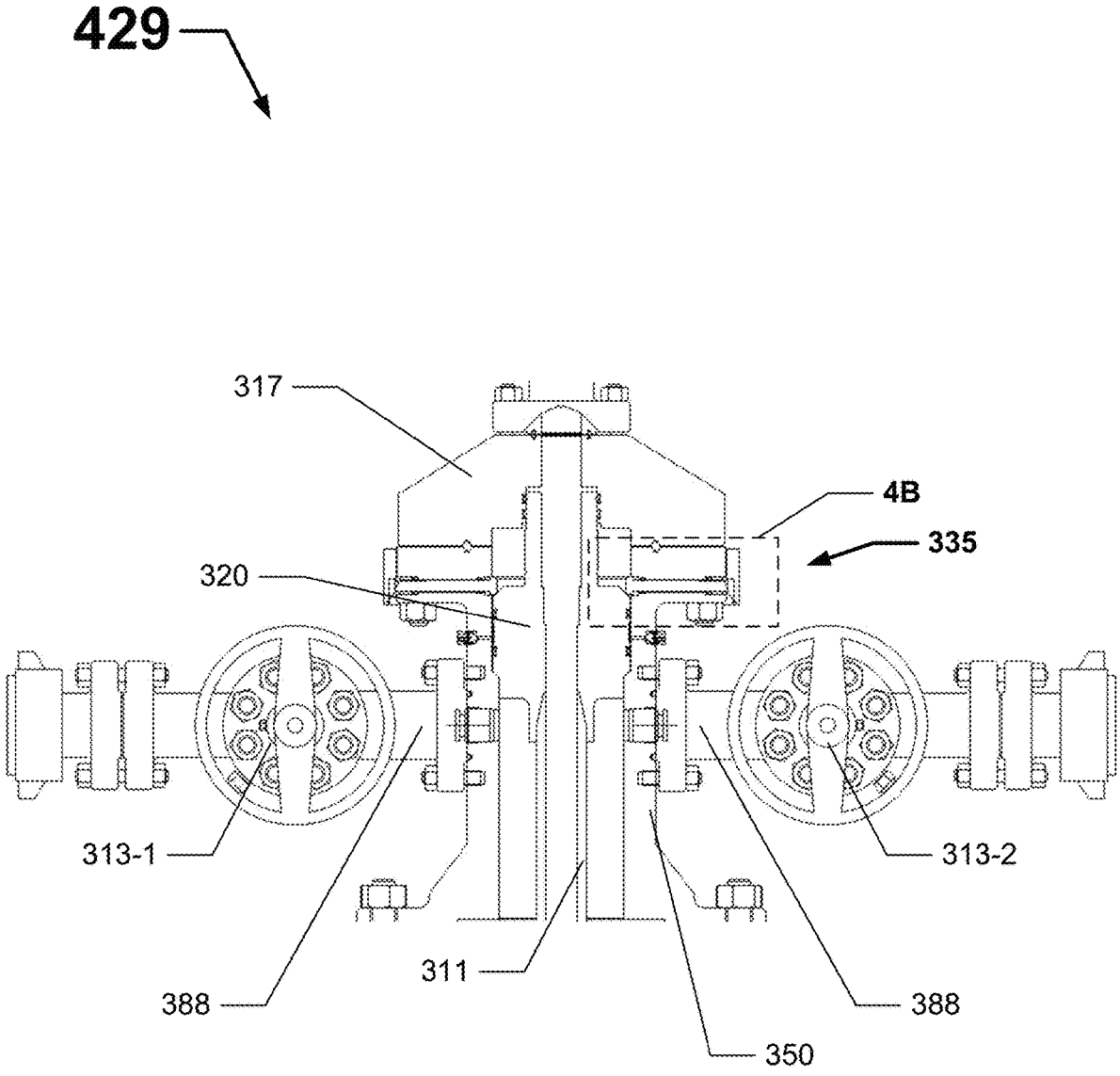
FIGS. 4A through 4C show various views of the wellhead assembly of FIGS. 3A through 3C with the retention pins of the tubing hanger retention system in an engaged position according to certain example embodiments.

As another example, as shown in FIGS. 3A and 4A below, the retention pin driver 180 can be or include a collar that is threadably coupled to the tubing spool 150. In such a case, the retention pin driver 180 can include an engagement surface (e.g., a chamfered bottom portion) that is configured to engage the proximal end of one or more of the retention pins 130 that is configured (e.g., have a chamfered proximal end) to complement the engagement surface of the retention pin driver 180. Under such a configuration, when the collar moves in a certain direction (e.g., downward), the collar contacts the proximal ends of the retention pins 130 and forces the retention pins 130 to move inward within the channels 151 of the tubing spool 150.

Figure 2A:
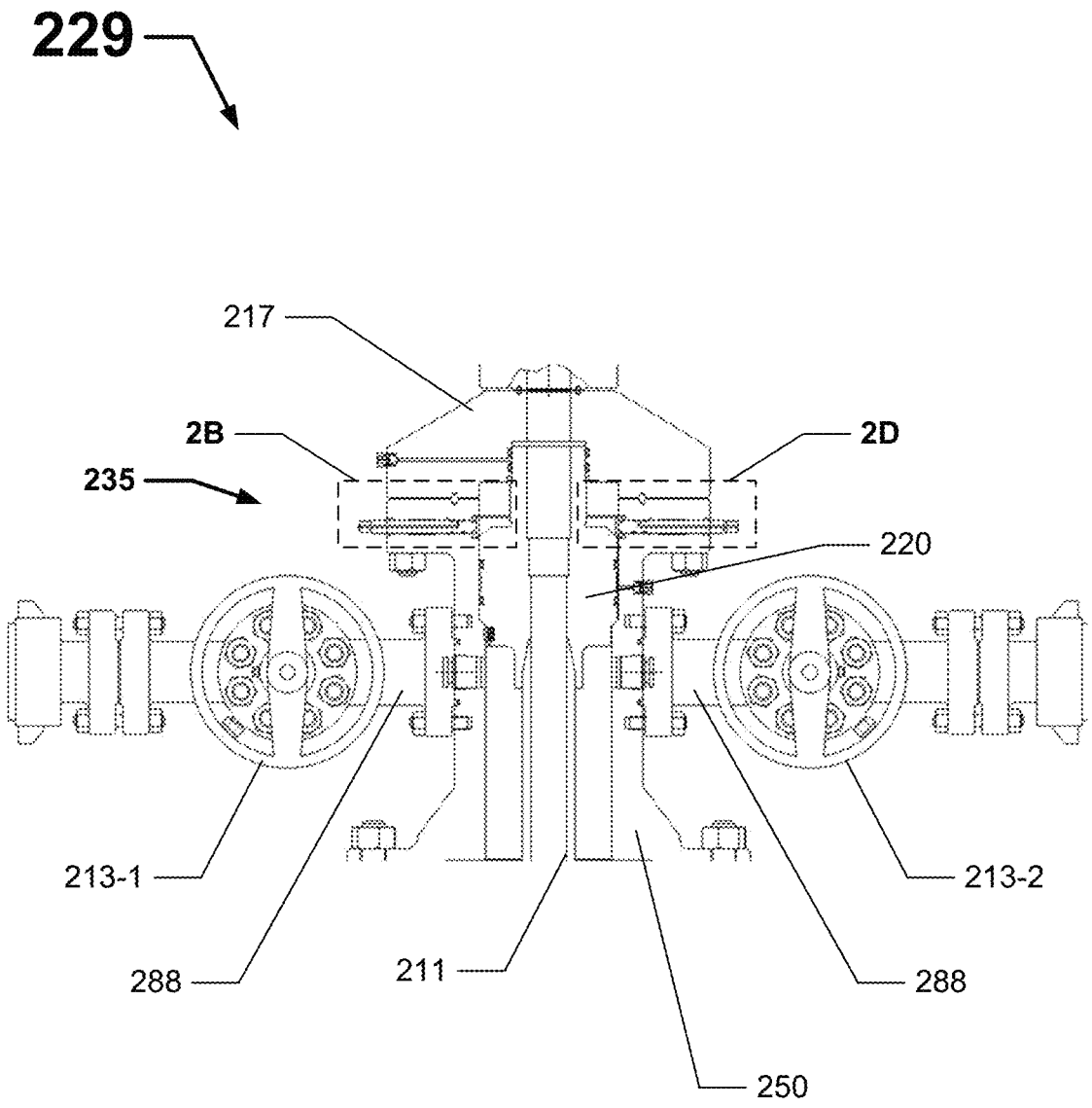
FIGS. 2A through 2E show various views of part of a wellhead assembly that includes a tubing hanger retention system according to certain example embodiments.
Figure 2B:
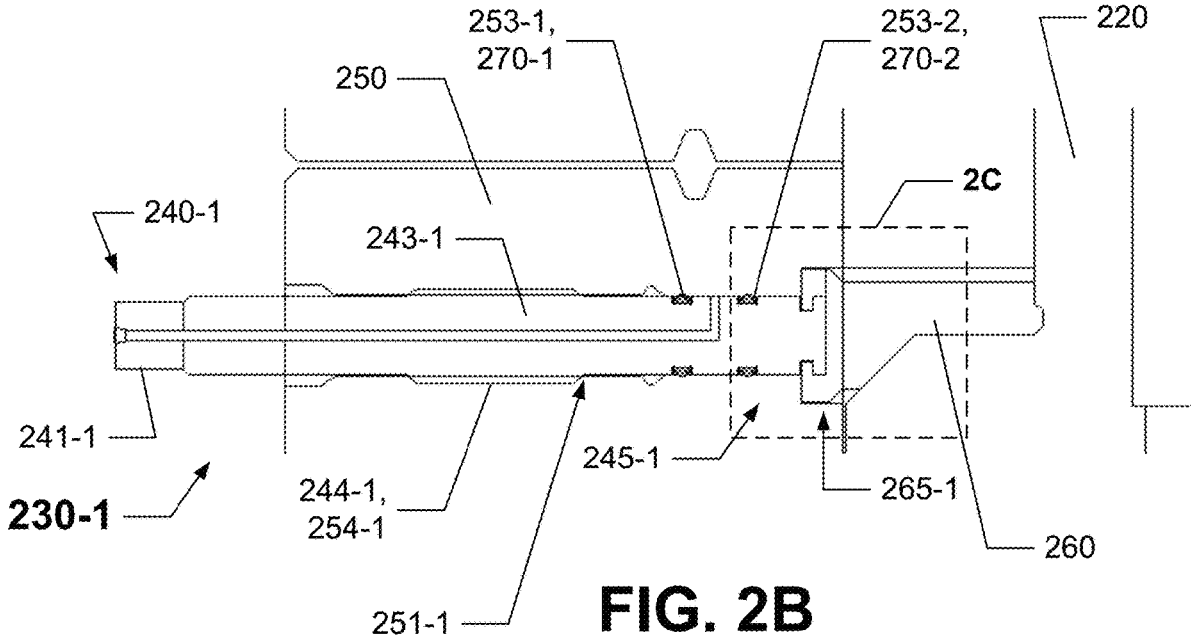
Figure 2C:
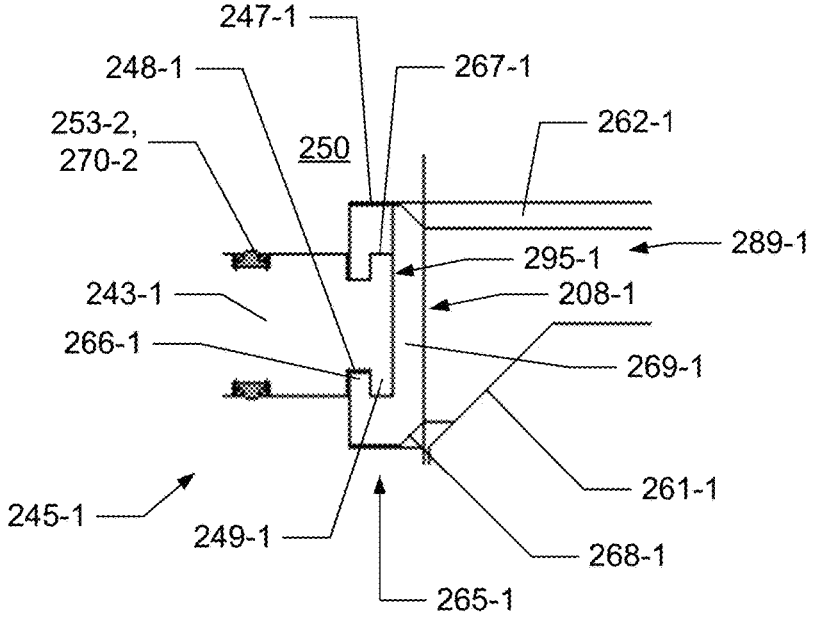
Figure 2D:
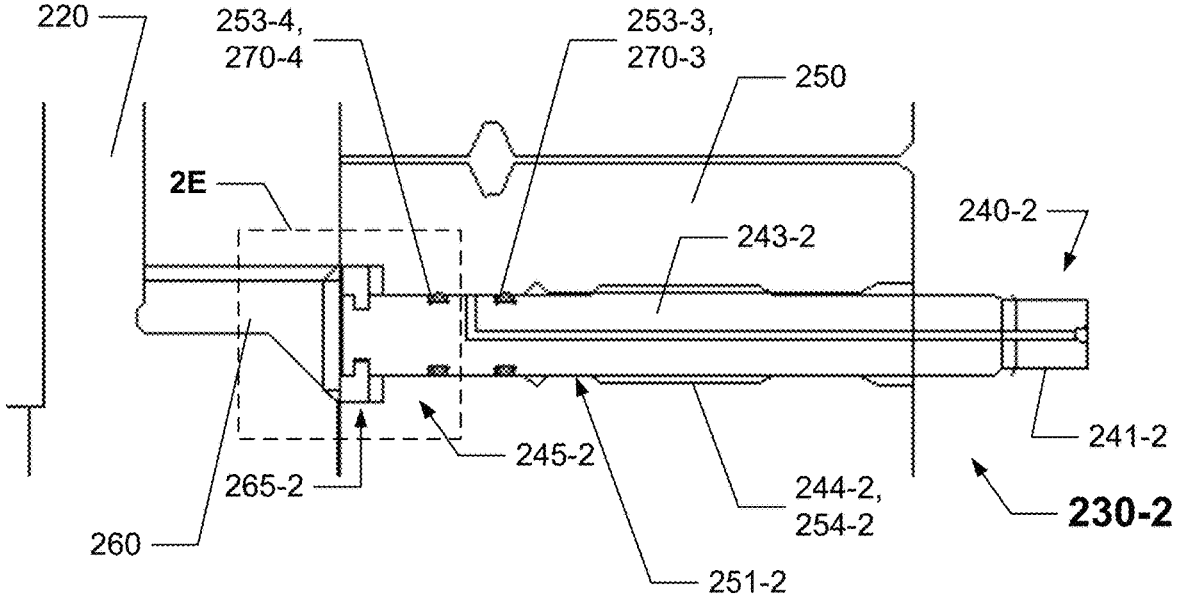
Figure 2E:
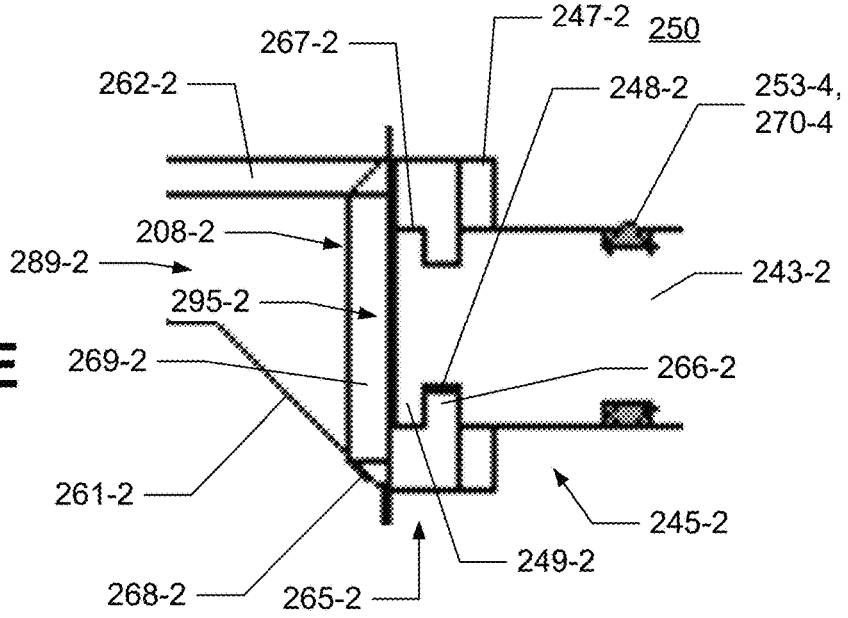

FIGS. 2A through 2E show various views of part of a wellhead assembly 229 that includes a tubing hanger retention system 235 according to certain example embodiments. Specifically, FIG. 2A shows a front view of the part of the wellhead assembly 229. FIG. 2B shows a detailed front view of part of the tubing hanger retention system 235 with the retention pin 230-1 in a captured state. FIG. 2C shows a further detailed front view of part of the tubing hanger retention system 235 of FIG. 2B with the retention pin 230-1 in the captured state. FIG. 2D shows a detailed front view of part of the tubing hanger retention system 235 with the retention pin 230-2 in an engaged state. FIG. 2E shows a further detailed front view of part of the tubing hanger retention system 235 of FIG. 2D with the retention pin 230-2 in the engaged state.

Referring to FIGS. 1 through 2E, the wellhead assembly 229 of FIGS. 2A through 2E includes a tubing spool 250, a tubing hanger 220, a tubing string 211, an upper wellhead 217, the tubing hanger retention system 235, multiple (in this case, two) valves 213 (valve 213-1 and valve 213-2), and piping 288. From the view provided in FIGS. 2A through 2E, the tubing hanger retention system 235 includes a retention ring 260 and two retention pins 230 (retention pin 230-1 and retention pin 230-2). The tubing spool 250, the tubing hanger 220, the tubing string 211, the upper wellhead 217, and the tubing hanger retention system 235 of the wellhead assembly 229 are substantially the same as the tubing spool 150, the tubing hanger 120, the tubing string 111, the upper wellhead 117, and the tubing hanger retention system 135 of the wellhead assembly 129 described above with respect to FIG. 1, except as discussed below. The piping 288 can include multiple pipes, ducts, elbows, joints, sleeves, collars, and similar components that are coupled to each other (e.g., using coupling features such as mating threads) to establish a network for transporting one or more fluids (e.g., an injection gas, a production fluid) at different times. Each component of the piping 288 can have an appropriate size (e.g., inner diameter, outer diameter) and be made of an appropriate material (e.g., steel, PVC) to safely and efficiently handle the pressure, temperature, flow rate, acidity, and other characteristics of the fluids that can flow therethrough.

Each of the valves 213 (also sometimes referred to a flow control valves 213 herein) can be placed in-line with the piping 288 at various locations in the wellhead assembly 229 to control the flow of one or more fluids at a given point in time. A valve 213 can have one or more of any of a number of configurations, including but not limited to a guillotine valve, a ball valve, a gate valve, a butterfly valve, a pinch valve, a needle valve, a plug valve, a diaphragm valve, and a globe valve. One valve 213 can be configured the same as or differently compared to another valve 213 in the wellhead assembly 229. Also, one valve 213 can be controlled (e.g., manually, automatically by a controller) the same as or differently compared to another valve 213 in the wellhead assembly 229.

Each valve 213 has a fully open position that allows a fluid to flow uninhibited therethrough and a fully closed position that prevents any fluid from flowing therethrough. In some cases, a valve 213 can also have any of a number of other positions (half open, a quarter closed, a quarter open) between fully open and fully closed that inhibit some amount of fluid flowing therethrough. Such other positions of a valve 213 can be discrete or continuous. One end of valve 213-1 is coupled to piping 288 that is directly coupled to the tubing spool 250. The other end of valve 213-1 is coupled to additional piping 288 that leads to another component of the wellhead assembly 229 and/or larger system. Similarly, one end of valve 213-2 is coupled to piping 288 that is directly coupled to the tubing spool 250. The other end of valve 213-2 is coupled to additional piping 288 that leads to another component of the wellhead assembly 229 and/or larger system.

In this example, the retention pins 230 are independently moveable within their respective channels 251 (also called tubing spool channels 251 herein) in the tubing spool 250 relative to the retention ring 260. In other words, the retention pin driver (e.g., retention pin driver 180) used to move the retention pins 230 within their respective channels 251 in the tubing spool 250 is used on one retention pin 230 at a time. Retention pin 230-1, featured in FIGS. 2B and 2C, is shown as being captured by the retention pin receiving feature 265-1 within the tubing spool channel 251-1. Retention pin 230-2, featured in FIGS. 2D and 2E, is shown as being engaged with a channel 289 (also called a retention ring channel 289 herein) within the tubing spool channel 251-2.

The retention pins 230 in this example are configured substantially the same as each other in this case. Each retention pin 230 is substantially cylindrically shaped and has a proximal end 240, a distal end 245, and a body 243 located between the proximal end 240 and the distal end 245. Disposed on the outer perimeter of part of the body 243 of each retention pin 230 in this case are mating threads 244. Also, there can be one or more channels 253 disposed in the body 243 axially around the outer perimeter of the body 243. Each channel 253 in the body 243 can be configured to receive a sealing member 270. Further, the distal end 245 of each retention pin 230 includes an engagement feature 295 that can be configured to be captured by one of the retention pin receiving features 265 located within one of the tubing spool channels 251 and subsequently engaged, when the retention pin 230 is moved inward within the tubing spool channel 251, with one of the retention ring channels 289. In addition, the proximal end 240 of each retention pin 230 can include a driver enablement feature 241 that is configured to engage with a retention pin driver (e.g., by a retention pin driver 180).

For example, retention pin 230-1 has a proximal end 240-1, a distal end 245-1, and a body 243-1 located between the proximal end 240-1 and the distal end 245-1. The body 243-1 of retention pin 230-1 has mating threads 244-1 disposed on a portion of the outer perimeter thereof. Further, channel 253-1 and channel 253-2 are disposed axially around the outer perimeter of the body 243-1 toward the distal end 245-1. In this example, channel 253-1 receives a sealing member 270-1, and channel 253-2 receives a sealing member 270-2. Further, the distal end 245-1 of retention pin 230-1 includes an engagement feature 295-1 that is coupled to an adapter 208-1, the collection of which is captured by retention pin receiving feature 265-1 disposed within the tubing spool channel 251-1 and subsequently engaged, when the retention pin 230-1 is moved inward within the tubing spool channel 251-1, with the retention ring channel 289-1 in the retention ring 260.

In addition, the proximal end 240-1 of retention pin 230-1 includes a driver enablement feature 241-1 (e.g., an octagonal cross-sectional shape along its outer surface, a hexagonal recess in the proximal end surface) that is configured to engage with a retention pin driver (e.g., by a retention pin driver 180). The retention pin driver rotates the retention pin 230-1, causing the mating threads 244-1 of the retention pin 230-1 to engage with the complementary mating threads 254-1 in part of the wall that forms the tubing spool channel 251-1. A rotation of the retention pin 230-1 in a certain direction (e.g., clockwise) causes the retention pin 230-1 to move inward within the tubing spool channel 251-1 until the engagement feature 295-1 (and so also the adapter 208-1) abut against the retention ring channel 289-1 of the retention ring 260, thereby engaging the retention pin 230-1. In this case, the retention pin 230-1 is not engaged.

Similarly, retention pin 230-2 has a proximal end 240-2, a distal end 245-2, and a body 243-2 located between the proximal end 240-2 and the distal end 245-2. The body 243-2 of retention pin 230-2 has mating threads 244-2 disposed on a portion of the outer perimeter thereof. Further, channel 253-3 and channel 253-4 are disposed axially around the outer perimeter of the body 243-2 toward the distal end 245-2. In this example, channel 253-3 receives a sealing member 270-3, and channel 253-4 receives a sealing member 270-4. Further, the distal end 245-2 of retention pin 230-2 includes an engagement feature 295-2 that is coupled to an adapter 208-2, the collection of which is captured by retention pin receiving feature 265-2 disposed within the tubing spool channel 251-2 and subsequently engaged, when the retention pin 230-2 is moved inward within the tubing spool channel 251-2, with the retention ring channel 289-2 in the retention ring 260.

In addition, the proximal end 240-2 of retention pin 230-2 includes a driver enablement feature 241-2 that is configured to engage with a retention pin driver (e.g., by a retention pin driver 180). The retention pin driver rotates the retention pin 230-2, causing the mating threads 244-2 of the retention pin 230-2 to engage with the complementary mating threads 254-2 in part of the wall that forms the tubing spool channel 251-2. A rotation of the retention pin 230-2 in a certain direction (e.g., clockwise) causes the retention pin 230-2 to move inward within the tubing spool channel 251-2 until the engagement feature 295-2 (and so also the adapter 208-2) abut against the retention ring channel 289-2 of the retention ring 260, thereby engaging the retention pin 230-2. In this case, the retention pin 230-2 is engaged (also said to be in an engaged state herein).

In this case, the sealing members 270 (sealing member 270-1, sealing member 270-2, sealing member 270-3, and sealing member 270-4) can be configured to form an interference fit with the inner surface of the respective channel 253 in which the sealing member 270 is positioned. In alternative embodiments, one or more of the sealing members 270 can be configured to form some other type of seal (e.g., a compression seal) with the respective channel 253 in which the sealing member 270 is positioned.

Referring to FIGS. 2B and 2C, the engagement feature 295-1 of the retention pin 230-1 is shown to be coupled to the adapter 208-1. The adapter 208-1 is an independent component that, when coupled to the engagement feature 295-1 at the distal end of the retention pin 230-1, effectively increases the diameter and the length of the engagement feature 295-1. In this way, the adapter 208-1 can be considered part of the engagement feature 295-1. The engagement feature 295-1 at the distal end 245-1 of the retention pin 230-1 in this case is defined by a recess (designated by surface 248-1) that separates an extension 249-1 at the distal end 245-1 from the remainder of the body 243 of the retention pin 230-1. The diameter of the extension 249-1, defined by the wall 267-1, in this case is substantially the same as the diameter of the body 243, and the diameter of the surface 248-1 for the recess is less than the diameter of the extension 249-1.

Similarly, referring to FIGS. 2D and 2E, the engagement feature 295-2 of the retention pin 230-2 is shown to be coupled to the adapter 208-2. The adapter 208-2 is an independent component that, when coupled to the engagement feature 295-2 at the distal end of the retention pin 230-2, effectively increases the diameter and the length of the engagement feature 295-2. In this way, the adapter 208-2 can be considered part of the engagement feature 295-2. The engagement feature 295-2 at the distal end 245-2 of the retention pin 230-2 in this case is defined by a recess (designated by surface 248-2) that separates an extension 249-2 at the distal end 245-2 from the remainder of the body 243 of the retention pin 230-2. The diameter of the extension 249-2 in this case is substantially the same as the diameter of the body 243, and the diameter of the surface 248-2 for the recess is less than the diameter of the extension 249-2.

Each of the retention pin receiving features 265 in this case is located at the distal end of a tubing spool channel 251. For example, as shown in FIG. 2C, retention ring receiving feature 265-1 is located at the distal end of tubing spool channel 251-1 and is defined by a wall 247-1 that has a diameter that is larger than the diameter of the remainder of the tubing spool channel 251-1. As another example, as shown in FIG. 2E, retention ring receiving feature 265-2 is located at the distal end of tubing spool channel 251-2 and is defined by a wall 247-2 that has a diameter that is larger than the diameter of the remainder of the tubing spool channel 251-2.

When the engagement feature 295 of a retention pin 230, and so also the associated adapter 208 in this example, are positioned within a retention pin receiving feature 265, the engagement feature 295 is said to be captured or in a captured state. In this case, the engagement feature 295-1 of retention pin 230-1 is captured by retention pin receiving feature 265-1 located at the distal end of tubing spool channel 251-1, and the engagement feature 295-2 of retention pin 230-2 is captured by retention pin receiving feature 265-2 located at the distal end of tubing spool channel 251-2.

When the engagement feature 295 of a retention pin 230 transitions to an engaged state, some or all of the portions of the engagement feature 295 that were positioned within the retention pin receiving feature 265 within the tubing spool channel 251 moves inward to become at least partially positioned outside of the tubing spool channel 251 and engages part of the adjoining retention ring channel 289. In this case, engagement feature 295-1 and the associated adapter 208-1 are located entirely outside the retention ring channel 289-1 and entirely inside of the tubing spool channel 251-1. As a result, engagement feature 295-1 and the associated adapter 208-1 are captured but not engaged. By contrast, engagement feature 295-2 and the associated adapter 208-2 are partially located within the retention ring channel 289-2 and partially within the tubing spool channel 251-2. As a result, engagement feature 295-2 and the associated adapter 208-2 are captured and engaged.

In light of the above, referring to FIGS. 2B and 2C, the configuration of the retention pin receiving feature 265-1 of the tubing spool channel 251-1 complements the configuration of the engagement feature 295-1 and associated adapter 208-1 of the retention pin 230-1. The adapter 208-1 includes a base 269-1 and an inward extension 266-1 at its distal end (away from the base 269-1). The inward extension 266-1 is configured to extend into and, in some cases, abut against the wall 247-1 that forms the retention pin receiving feature 265-1. As such, the characteristics (e.g., length, thickness, distance from the base 269-1) of the inward extension 266-1 complement the corresponding characteristics (e.g., radius of the surface 248-1, thickness of the recess defined by the surface 248-1, distance of the recess from the distal end of the extension 249-1) of the engagement feature 295-1. As discussed above, the purpose of the adapter 208-1 is to increase one or more of the dimensions (e.g., the diameter, the thickness) of the engagement feature 295-1 to facilitate capture of the engagement feature 295-1 by the retention pin receiving feature 265-1.

The engagement feature 295-1 and accompanying adapter 208-1 can move within the retention ring channel 289-1 in the retention ring 260. When the tubing spool 250, the tubing hanger 220, and the retention ring 260 of the example tubing hanger retention system 235 are assembled into the wellhead assembly 229, the retention pin receiving feature 265-1 at the distal end of the tubing spool channel 251-1 can be substantially aligned with the retention ring channel 289-1. The diameter of the retention ring channel 289-1, at least at its entrance (at its distal end) can be large enough to allow at least the distal end of the engagement feature 295-1 and accompanying adapter 208-1 to enter therein.

The top of the retention ring channel 289-1 can include one or more features 262-1 (e.g., a slot, planar surfaces) that complement the features of the base 269-1 of the engagement feature 295-1. In this way, the engagement feature 295-1 can be sufficiently oriented with respect to the retention ring channel 289-1 and move (e.g., slide) therein. The retention ring channel 289-1 can also have a slanted bottom surface 261-1 that provides for a larger diameter at its distal end and a gradually decreasing diameter traveling inward through the retention ring channel 289-1. By reducing (in this case, gradually) the size of the retention ring channel 289-1 from the distal end inward, the size of the retention ring channel 289-1 eventually becomes smaller than the size of the adapter 208-1, causing the inward movement of the retention pin 230-1 to stop. At that point, the retention pin 230-1 becomes engaged with the retention ring channel 289-1. The slanted bottom surface 261-1 can serve to complement a chamfer 268-1 (or other feature) in the outer distal surface of the base 269-1 of the engagement feature 295-1.

Referring to FIGS. 2D and 2E, the configuration of the retention pin receiving feature 265-2 of the tubing spool channel 251-2 complements the configuration of the engagement feature 295-2 and associated adapter 208-2 of the retention pin 230-2. The adapter 208-2 includes a base 269-2 and an inward extension 266-2 at its distal end (away from the base 269-2). The inward extension 266-2 is configured to extend into and, in some cases, abut against the wall 247-2 that forms the retention pin receiving feature 265-2. As such, the characteristics (e.g., length, thickness, distance from the base 269-2) of the inward extension 266-2 complement the corresponding characteristics (e.g., radius of the surface 248-2, thickness of the recess defined by the surface 248-2, distance of the recess from the distal end of the extension 249-2) of the engagement feature 295-2. As discussed above, the purpose of the adapter 208-2 is to increase one or more of the dimensions (e.g., the diameter, the thickness) of the engagement feature 295-2 to facilitate capture of the engagement feature 295-2 by the retention pin receiving feature 265-2.

The engagement feature 295-2 and accompanying adapter 208-2 can move within the retention ring channel 289-2 in the retention ring 260. When the tubing spool 250, the tubing hanger 220, and the retention ring 260 of the example tubing hanger retention system 235 are assembled into the wellhead assembly 229, the retention pin receiving feature 265-2 at the distal end of the tubing spool channel 251-2 can be substantially aligned with the retention ring channel 289-2. The diameter of the retention ring channel 289-2, at least at its entrance (at its distal end) can be large enough to allow at least the distal end of the engagement feature 295-2 and accompanying adapter 208-2 to enter therein.

The top of the retention ring channel 289-2 can include one or more features 262-2 (e.g., a slot, planar surfaces) that complement the features of the base 269-2 of the engagement feature 295-2. In this way, the engagement feature 295-2 can be sufficiently oriented with respect to the retention ring channel 289-2 and move (e.g., slide) therein. The retention ring channel 289-2 can also have a slanted bottom surface 261-2 that provides for a larger diameter at its distal end and a gradually decreasing diameter traveling inward through the retention ring channel 289-2. By reducing (in this case, gradually) the size of the retention ring channel 289-2 from the distal end inward, the size of the retention ring channel 289-2 eventually becomes smaller than the size of the adapter 208-2, causing the inward movement of the retention pin 230-2 to stop. At that point, as shown in FIG. 2E, the retention pin 230-2 becomes engaged with (becomes wedged against) the retention ring channel 289-2. The slanted bottom surface 261-2 can serve to complement a chamfer 268-2 (or other feature) in the outer distal surface of the base 269-2 of the engagement feature 295-2.

Figure 4B:
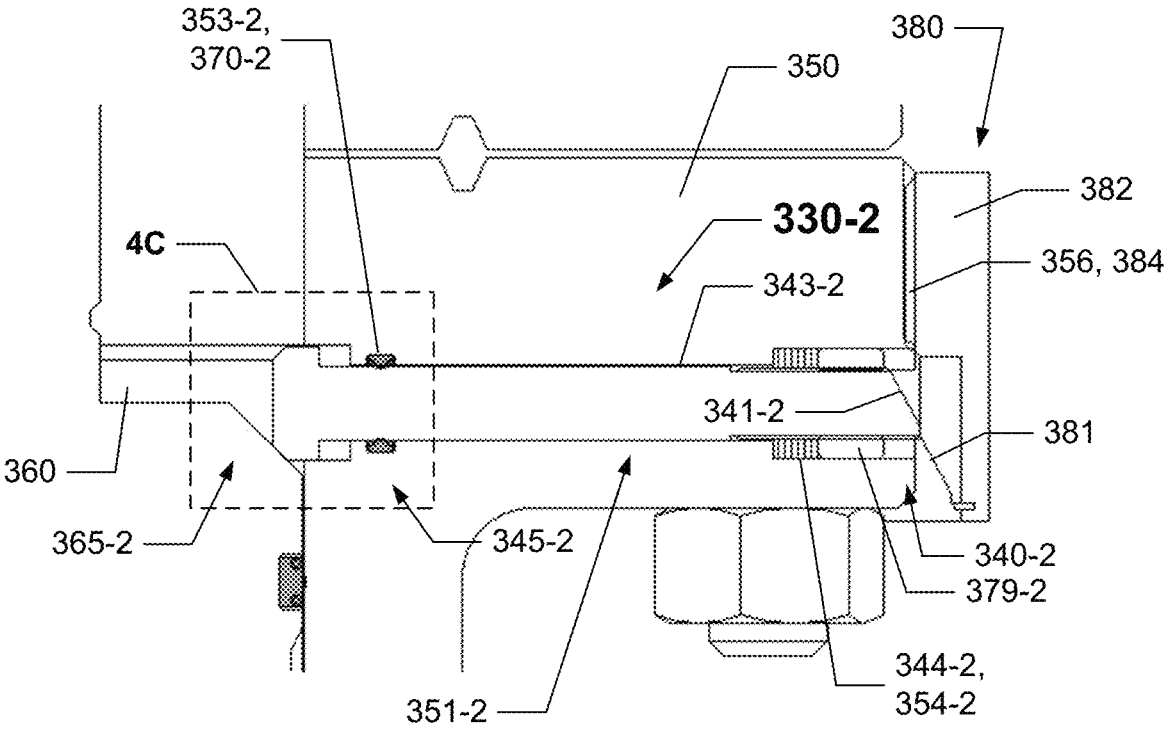
Figure 4C:
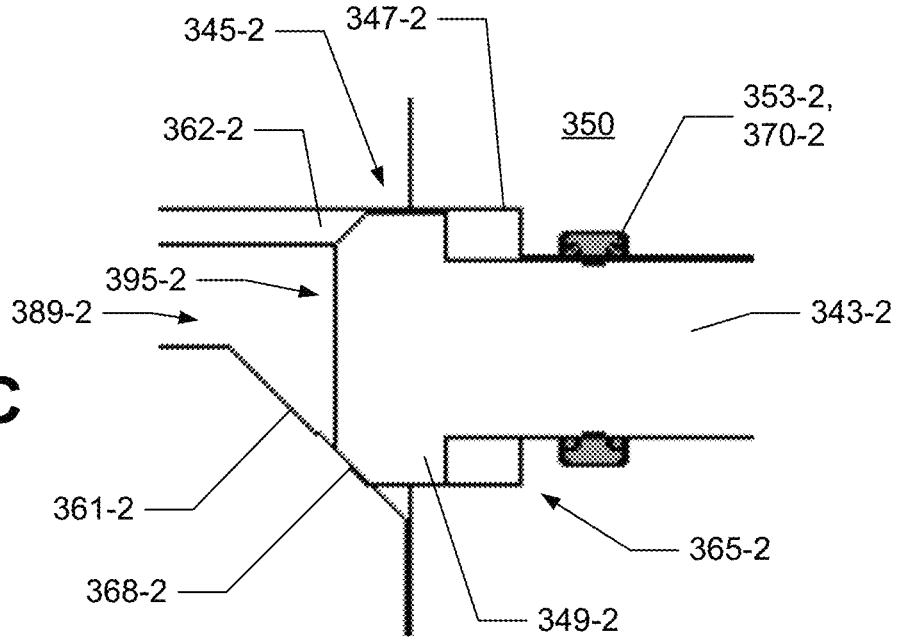

FIGS. 3A through 3C show various views of another wellhead assembly 329 that includes a tubing hanger retention system 335 with retention pins 330 in a captured position according to certain example embodiments. FIGS. 4A through 4C show various views of the wellhead assembly 329 of FIGS. 3A through 3C with the retention pins 330 of the tubing hanger retention system 335 in an engaged position according to certain example embodiments. Specifically, FIG. 3A shows a front view of the part of the wellhead assembly 329 with the retention pins 330 of the tubing hanger retention system 335 in a captured state. FIG. 3B shows a detailed front view of part of the tubing hanger retention system 335 of FIG. 3A with the retention pin 330-1 in the captured state. FIG. 3C shows a further detailed front view of part of the tubing hanger retention system 335 of FIG. 3B with the retention pin 330-1 in the captured state. FIG. 4A shows a front view of the part of the wellhead assembly 329 with the retention pins 330 of the tubing hanger retention system 335 in an engaged state. FIG. 4B shows a detailed front view of part of the tubing hanger retention system 335 of FIG. 4A with the retention pin 330-2 in the engaged state. FIG. 4C shows a further detailed front view of part of the tubing hanger retention system 335 of FIG. 4B with the retention pin 330-2 in the engaged state.

Referring to FIGS. 1 through 4C, the wellhead assembly 329 of FIGS. 3A through 4C includes a tubing spool 350, a tubing hanger 320, a tubing string 311, an upper wellhead 317, the tubing hanger retention system 335, multiple (in this case, two) valves 313 (valve 313-1 and valve 313-2), and piping 388. From the views provided in FIGS. 3B, 3C, 4B, and 4C, the tubing hanger retention system 335 includes a retention ring 360, a retention pin driver 380, and two retention pins 330 (retention pin 330-1 and retention pin 330-2). The tubing spool 350, the tubing hanger 320, the tubing string 311, the piping 388, the valves 313, the upper wellhead 317, and the tubing hanger retention system 335 of the wellhead assembly 329 are substantially the same as the tubing spool 150, the tubing hanger 120, the tubing string 111, the piping 288, the valves 213, the upper wellhead 117, and the tubing hanger retention systems (e.g., tubing hanger retention system 135, tubing hanger retention system 235) of the wellhead assemblies (e.g., wellhead assembly 129, wellhead assembly 229) described above, except as discussed below.

One end of valve 313-1 is coupled to piping 388 that is directly coupled to the tubing spool 350. The other end of valve 313-1 is coupled to additional piping 388 that leads to another component of the wellhead assembly 329 and/or larger system. Similarly, one end of valve 313-2 is coupled to piping 388 that is directly coupled to the tubing spool 350. The other end of valve 313-2 is coupled to additional piping 388 that leads to another component of the wellhead assembly 329 and/or larger system.

In this example, the retention pins 330 are simultaneously moveable within their respective channels 351 (also called tubing spool channels 351 herein) in the tubing spool 350 relative to the retention ring 360. In other words, the retention pin driver 380 used to move the retention pins 330 within their respective tubing spool channels 351 is used on all of the retention pins 330 at once. Retention pin 330-1, featured in FIGS. 3B and 3C, is shown as being captured by the retention pin receiving feature 365-1 within the tubing spool channel 351-1. Retention pin 330-2, featured in FIGS. 4B and 4C, is shown as being engaged with a channel 389 (also called a retention ring channel 389 herein) within the tubing spool channel 351-2.

The retention pin driver 380 has a body 382 that is disposed over the outer perimeter of the tubing spool 350. In this case, there are mating threads 384 disposed on at least a portion of the inner surface of the body 382 of the retention pin driver 380. The mating threads 384 of the retention pin driver 380 are configured to engage with the complementary mating threads 356 in part of the outer surface of the tubing spool 350 as the retention pin driver 380 rotates. A rotation of the retention pin driver 380 in a certain direction (e.g., clockwise) causes the retention pin driver 380 to move in one direction (e.g., downward) relative to the tubing spool 250, while a rotation of the retention pin driver 380 in the opposite direction (e.g., counter-clockwise) causes the retention pin driver 380 to move in an opposite direction (e.g., upward) relative to the tubing spool 250. The retention pin driver 380 has one or more features (in this case, a chamfered bottom end 381, discussed below) that engage the retention pins 330 to move the retention pins 330 within their respective tubing spool channels 351 at substantially the same time.

The retention pins 330 in this example are configured substantially the same as each other in this case. Each retention pin 330 is substantially cylindrically shaped and has a proximal end 340, a distal end 345, and a body 343 located between the proximal end 340 and the distal end 345. There are no mating threads (e.g., mating threads 244) on the outer perimeter of any part of the body 343 of the retention pins 330 in this case. Also, there can be one or more channels 353 disposed in the body 343 axially around the outer perimeter of the body 343. Each channel 353 in the body 343 can be configured to receive a sealing member 370. Further, the distal end 345 of each retention pin 330 includes an engagement feature 395 that can be configured to be captured by one of the retention pin receiving features 365 located within one of the tubing spool channels 351 and subsequently engaged, when the retention pin 330 is moved inward within the tubing spool channel 351, with one of the retention ring channels 389. In addition, the proximal end 340 of each retention pin 330 can include a driver enablement feature 341 that is configured to engage with the retention pin driver 380.

For example, retention pin 330-1 has a proximal end 340-1, a distal end 345-1, and a body 343-1 located between the proximal end 340-1 and the distal end 345-1. There are no coupling features (e.g., mating threads) disposed on the outer perimeter of the body 343-1 of the retention pin 330-1. Further, channel 353-1 is disposed axially around the outer perimeter of the body 343-1 toward the distal end 345-1. In this example, channel 353-1 receives a sealing member 370-1. Further, the distal end 345-1 of retention pin 330-1 includes an engagement feature 395-1 that is captured by retention pin receiving feature 365-1 disposed within the tubing spool channel 351-1 and subsequently engaged, when the retention pin 330-1 is moved inward within the tubing spool channel 351-1, with the retention ring channel 389-1 in the retention ring 360. There is no adapter (e.g., adapter 208-1) for the engagement feature 395-1 in this case.

In addition, the proximal end 340-1 of retention pin 330-1 includes a driver enablement feature 341-1 (e.g., a chamfered outer end) that is configured to engage with the retention pin driver 380, which in this case includes a chamfered bottom end 381 that complements the chamfered outer end of the driver enablement feature 341-1. In this case, as the retention pin driver 380 rotates in a particular direction (e.g., downward) relative to the tubing spool 350, the chamfered bottom end 381 the retention pin driver 380 contacts the driver enablement feature 341-1 of the retention pin 330-1. As the retention pin driver 380 continues its movement in the same direction, the chamfered bottom end 381 pushes the retention pin 330-1, through the driver enablement feature 341-1, inward within the tubing spool channel 351-1. This inward movement of the retention pin 330-1 within the tubing spool channel 351-1 can continue until the engagement feature 395-1 abuts against the retention ring channel 389-1 of the retention ring 360, thereby engaging the retention pin 330-1. In this case, the retention pin 330-1, while captured, is not engaged.

The retention pin 330-1 also includes an extension 379-1 that extends laterally away from the body 343 toward the proximal end 340-1 of the retention pin 330-1. The extension 379-1 has a diameter that is substantially the same as, or slightly smaller than, the diameter of a recess 344-1 toward the proximal end of the tubing spool channel 351-1. The recess 344-1 in the tubing spool channel 351-1 is longer than the length of the extension 379-1 of the extension pin 330-1. Also, the diameter of the recess 344-1 in the tubing spool channel 351-1 is greater than the diameter of the extension 379-1 of the extension pin 330-1. In this way, the extension 379-1 can move within the recess 344-1 as the retention pin 330-1 moves within the tubing spool channel 351-1. The length of the recess 344-1 can be large enough to receive the extension 379-1 for the entire possible range of motion of the retention pin 330-1 within the tubing spool channel 351-1.

In some cases, as in this example, the retention pin 330-1 can also include a resilient device 354-1 disposed around the body 343 between the extension 379-1 and the extension 349-1 of the engagement feature 395-1. In such a case, the resilient device 354-1 can be positioned adjacent to the extension 379-1 toward the proximal end of the retention pin 330-1. The resilient device 354-1 can be configured to transition, potentially multiple times, between a default state (as when the retention pin 330-1 is in a captured state but not in an engaged state, as shown in FIG. 3C) and a compressed state (as when the retention pin 330 (e.g., retention pin 330-2) is in a captured state and an engaged state, as shown in FIG. 4C). Examples of a resilient device 354-1 can include, but are not limited to, a conical spring washer, a Belleville washer, a coned-disc spring, a disc spring, a Belleville spring, a cupped spring washer, and a compression spring.

Similarly, retention pin 330-2 has a proximal end 340-2, a distal end 345-2, and a body 343-2 located between the proximal end 340-2 and the distal end 345-2. There are no coupling features (e.g., mating threads) disposed on the outer perimeter of the body 343-2 of the retention pin 330-2. Further, channel 353-2 is disposed axially around the outer perimeter of the body 343-2 toward the distal end 345-2. In this example, channel 353-2 receives a sealing member 370-2. Further, the distal end 345-2 of retention pin 330-2 includes an engagement feature 395-2 that is captured by retention pin receiving feature 365-2 disposed within the tubing spool channel 351-2 and subsequently engaged, when the retention pin 330-2 is moved inward within the tubing spool channel 351-2, with the retention ring channel 389-2 in the retention ring 360. There is no adapter (e.g., adapter 208-2) for the engagement feature 395-2 in this case.

In addition, the proximal end 340-2 of retention pin 330-2 includes a driver enablement feature 341-2 (e.g., a chamfered outer end) that is configured to engage with the retention pin driver 380, which in this case includes a chamfered bottom end 381 that complements the chamfered outer end of the driver enablement feature 341-2. In this case, as the retention pin driver 380 rotates in a particular direction (e.g., downward) relative to the tubing spool 350, the chamfered bottom end 381 the retention pin driver 380 contacts the driver enablement feature 341-2 of the retention pin 330-2. As the retention pin driver 380 continues its movement in the same direction, the chamfered bottom end 381 pushes the retention pin 330-2, through the driver enablement feature 341-2, inward within the tubing spool channel 351-2. This inward movement of the retention pin 330-2 within the tubing spool channel 351-2 can continue until the engagement feature 395-2 abuts against the retention ring channel 389-2 of the retention ring 360, thereby engaging the retention pin 330-2. In this case, the retention pin 330-2 is engaged as well as captured.

The retention pin 330-2 also includes an extension 379-2 that extends laterally away from the body 343 toward the proximal end 340-2 of the retention pin 330-2. The extension 379-2 has a diameter that is substantially the same as, or slightly smaller than, the diameter of a recess 344-2 toward the proximal end of the tubing spool channel 351-2. The recess 344-2 in the tubing spool channel 351-2 is longer than the length of the extension 379-2 of the extension pin 330-2. Also, the diameter of the recess 344-2 in the tubing spool channel 351-2 is greater than the diameter of the extension 379-2 of the extension pin 330-2. In this way, the extension 379-2 can move within the recess 344-2 as the retention pin 330-2 moves within the tubing spool channel 351-2. The length of the recess 344-2 can be large enough to receive the extension 379-2 for the entire possible range of motion of the retention pin 330-2 within the tubing spool channel 351-2.

In some cases, as in this example, the retention pin 330-2 can also include a resilient device 354-2 disposed around the body 343 between the extension 379-2 and the extension 349-2 of the engagement feature 395-2. In such a case, the resilient device 354-2 can be positioned adjacent to the extension 379-2 toward the proximal end of the retention pin 330-2. The resilient device 354-2 can be configured to transition, potentially multiple times, between a default state (as when the retention pin 330-2 is in a captured state but not in an engaged state, as shown in FIG. 3C with respect to the retention pin 330-1) and a compressed state (as when the retention pin 330-2 is in a captured state and an engaged state, as shown in FIG. 4C). The resilient device 354-2 can be substantially the same as the resilient device 354-1 discussed above.

In this case, the sealing members 370 (sealing member 370-1 and sealing member 370-2) can be configured to form an interference fit with the inner surface of the respective channel 353 in which the sealing member 370 is positioned. In alternative embodiments, one or more of the sealing members 370 can be configured to form some other type of seal (e.g., a compression seal) with the respective channel 353 in which the sealing member 370 is positioned.

Referring to FIGS. 3B and 3C, the engagement feature 395-1 of the retention pin 330-1 is configured in such a way that an adapter (e.g., adapter 208-1) is not needed. The engagement feature 395-1 at the distal end 345-1 of the retention pin 330-1 in this case is defined by an extension 349-1 that has a diameter that is substantially the same as, or slightly smaller than, the diameter of the retention ring receiving feature 365-1 located at the distal end of tubing spool channel 351-1 and defined by wall 347-1. Also, the thickness of the extension 349-1 of the engagement feature 395-1 in this case is substantially the same as, or slightly smaller than, the length of the wall 347-1 that defines the thickness of the retention ring receiving feature 365-1.

Each of the retention pin receiving features 365 in this case is located at the distal end of a tubing spool channel 351. For example, as shown in FIG. 3C, retention ring receiving feature 365-1 is located at the distal end of tubing spool channel 351-1, and the wall 347-1 that defines the retention ring receiving feature 365-1 has a diameter that is larger than the diameter of the remainder of the tubing spool channel 351-1. As another example, as shown in FIG. 4C, retention ring receiving feature 365-2 is located at the distal end of tubing spool channel 351-2, and the wall 347-2 that defines the retention ring receiving feature 365-2 has a diameter that is larger than the diameter of the remainder of the tubing spool channel 351-2.

When the engagement feature 395 of a retention pin 330 is positioned within a retention pin receiving feature 365, the engagement feature 395 is said to be captured or in a captured state. In this case, the engagement feature 395-1 of retention pin 330-1 is captured by retention pin receiving feature 365-1 located at the distal end of tubing spool channel 351-1, and the engagement feature 395-2 of retention pin 330-2 is captured by retention pin receiving feature 365-2 located at the distal end of tubing spool channel 351-2.

When the engagement feature 395 of a retention pin 330 transitions to an engaged state, some or all of the portions of the engagement feature 395 that were positioned within the retention pin receiving feature 365 within the tubing spool channel 351 moves inward to become positioned at least partly outside of the tubing spool channel 351 and engages part of the adjoining retention ring channel 389. In this case, engagement feature 395-1 is located entirely outside the retention ring channel 389-1 and entirely inside of the tubing spool channel 351-1. As a result, engagement feature 395-1 is captured but not engaged. By contrast, engagement feature 395-2 is partially located within the retention ring channel 289-2 and partially within the tubing spool channel 251-2. As a result, engagement feature 395-2 is captured and engaged.

In light of the above, referring to FIGS. 3B and 3C, the configuration of the retention pin receiving feature 365-1 of the tubing spool channel 351-1 complements the configuration of the engagement feature 395-1 of the retention pin 330-1. The extension 349-1 of the engagement feature 395-1 in this case extends into the retention pin receiving feature 365-1 and abuts against the wall 347-1 that forms the retention pin receiving feature 365-1. As such, the characteristics (e.g., length, thickness) of the extension 349-1 of the engagement feature 395-1 complement the corresponding characteristics (e.g., length of the wall 347-1, diameter) of the retention pin receiving feature 365-1.

The engagement feature 395-1 can move within the retention ring channel 389-1 in the retention ring 360. When the tubing spool 350, the tubing hanger 320, and the retention ring 360 of the example tubing hanger retention system 335 are assembled into the wellhead assembly 329, the retention pin receiving feature 365-1 at the distal end of the tubing spool channel 351-1 can be substantially aligned with the retention ring channel 389-1 of the retention ring 360. The diameter of the retention ring channel 389-1, at least at its entrance (at its distal end) can be large enough to allow at least the distal end of the engagement feature 395-1 to enter therein.

The top of the retention ring channel 389-1 can include one or more features 362-1 (e.g., a slot, planar surfaces) that complement the features of the extension 349-1 of the engagement feature 395-1. In this way, the engagement feature 395-1 can be sufficiently oriented with respect to the retention ring channel 289-1 and move (e.g., slide) therein. The retention ring channel 389-1 can also have a slanted bottom surface 361-1 that provides for a larger diameter at its distal end and a gradually decreasing diameter traveling inward through the retention ring channel 389-1. By reducing (in this case, gradually) the size of the retention ring channel 389-1 from the distal end inward, the size of the retention ring channel 389-1 eventually becomes smaller than the size of the engagement feature 395-1, causing the inward movement of the retention pin 330-1 to stop. At that point, the retention pin 330-1 becomes engaged with the retention ring channel 389-1. The slanted bottom surface 361-1 can serve to complement a chamfer 368-1 (or other feature) in the outer distal surface of the extension 349-1 of the engagement feature 395-1.

Referring to FIGS. 4B and 4C, the configuration of the retention pin receiving feature 365-2 within the tubing spool channel 351-2 complements the configuration of the engagement feature 395-2 of the retention pin 330-2. The extension 349-2 of the engagement feature 395-2 in this case extends into the retention pin receiving feature 365-2 and abuts against the wall 347-2 that forms the retention pin receiving feature 365-2. As such, the characteristics (e.g., length, thickness) of the extension 349-2 of the engagement feature 395-2 complement the corresponding characteristics (e.g., length of the wall 347-2, diameter) of the retention pin receiving feature 365-2.

The engagement feature 395-2 can move within the retention ring channel 389-2 in the retention ring 360. When the tubing spool 350, the tubing hanger 320, and the retention ring 360 of the example tubing hanger retention system 335 are assembled into the wellhead assembly 329, the retention pin receiving feature 365-2 at the distal end of the tubing spool channel 351-2 can be substantially aligned with the retention ring channel 389-2 of the retention ring 360. The diameter of the retention ring channel 389-2, at least at its entrance (at its distal end) can be large enough to allow at least the distal end of the engagement feature 395-2 to enter therein.

The top of the retention ring channel 389-2 can include one or more features 362-2 (e.g., a slot, planar surfaces) that complement the features of the extension 349-2 of the engagement feature 395-2. In this way, the engagement feature 395-2 can be sufficiently oriented with respect to the retention ring channel 289-2 and move (e.g., slide) therein. The retention ring channel 389-2 can also have a slanted bottom surface 361-2 that provides for a larger diameter at its distal end and a gradually decreasing diameter traveling inward through the retention ring channel 389-2. By reducing (in this case, gradually) the size of the retention ring channel 389-2 from the distal end inward, the size of the retention ring channel 389-2 eventually becomes smaller than the size of the engagement feature 395-2, causing the inward movement of the retention pin 330-2 to stop. At that point, as shown in FIG. 4C, the retention pin 330-2 becomes engaged with the retention ring channel 389-2. The slanted bottom surface 361-2 can serve to complement a chamfer 368-2 (or other feature) in the outer distal surface of the extension 349-2 of the engagement feature 395-2.

In some cases, the engagement feature 395 of a retention pin 330 can be of a fixed shape and size. In cases such as this, where the diameter of the engagement feature 395 is larger than the diameter of the body 343 of the retention pin 330, the retention pin 330 needs to be inserted into the tubing spool channel 351 of the tubing spool 350 before the tubing spool 350 is assembled with the wellhead assembly 329. Alternatively, the engagement feature 395 of a retention pin 330 can be expandable. In such a case, the engagement feature 395 can initially be contracted so that the diameter of the engagement feature is no greater than the diameter of the body 343 of the retention pin 330. This allows the retention pin 330 to be inserted into a tubing spool channel 351 from the outside. Once the engagement feature 395 is positioned within the retention pin receiving feature 365 disposed in the tubing spool channel 351, the engagement feature 395 can be expanded and captured by the retention pin receiving feature 365.

Figure 5:
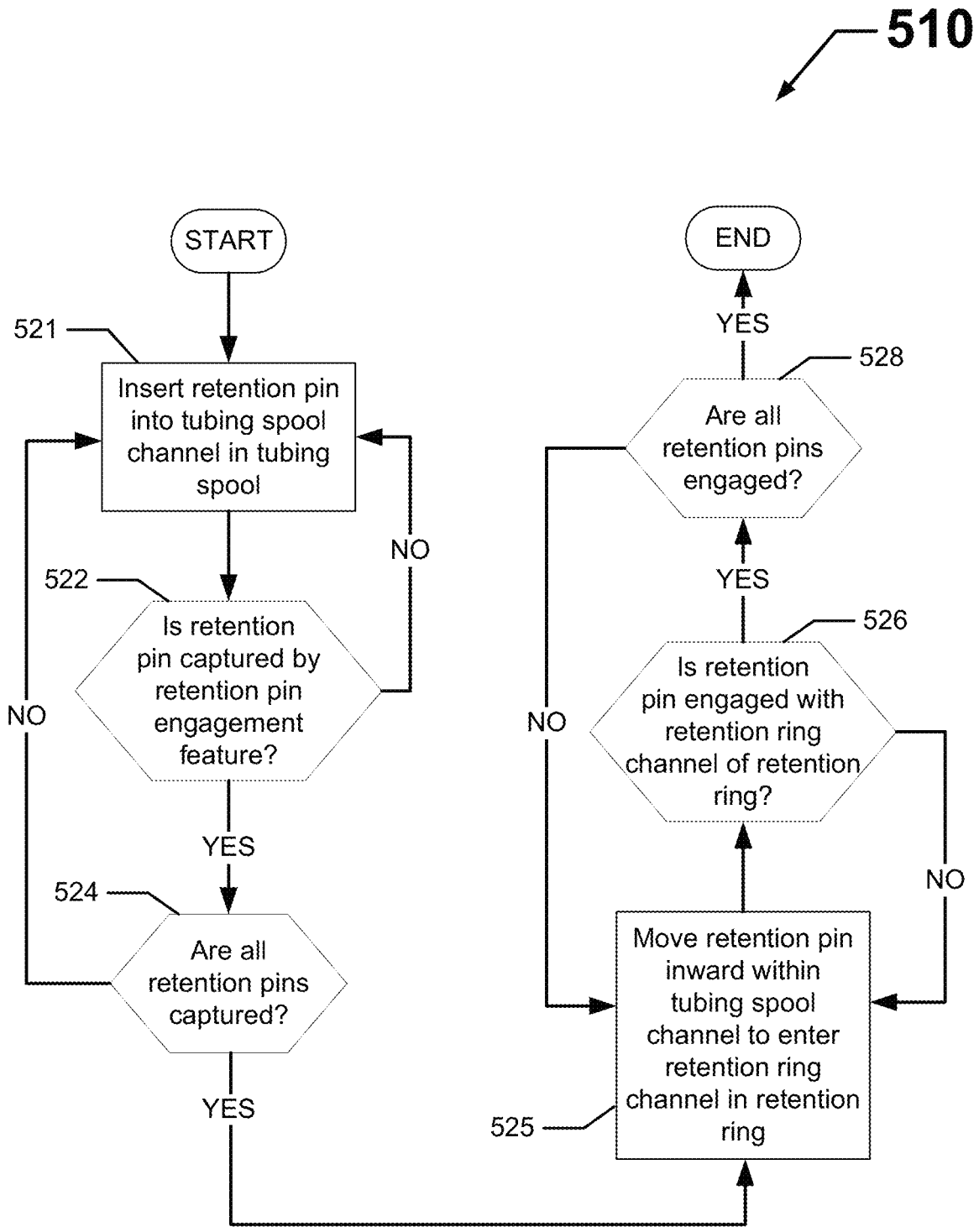
FIG. 5 shows a flowchart for a method of securing retention pins in a wellhead assembly according to certain example embodiments.

FIG. 5 shows a flowchart 510 for a method of securing retention pins in a wellhead assembly according to certain example embodiments. While the various steps in this flowchart 510 are presented sequentially, one of ordinary skill will appreciate that some or all of the steps may be executed in different orders, may be combined or omitted, and some or all of the steps may be executed in parallel. Further, in one or more of the example embodiments, one or more of the steps shown in this example method may be omitted, repeated, and/or performed in a different order. Some or all of the steps of the method of FIG. 5 can be performed off site (e.g., at a manufacturing facility, at a staging area). In addition, or in the alternative, some or all of the steps of the method of FIG. 5 can be performed on site (e.g., in the field, adjacent to a wellbore 123) where a field operation is being performed or planned.

In addition, a person of ordinary skill in the art will appreciate that additional steps not shown in FIG. 5 may be included in performing this method. Accordingly, the specific arrangement of steps should not be construed as limiting the scope. Further, a particular computing device, such as a controller 104 discussed above with respect to FIG. 1, can be used to perform one or more of the steps (or portions thereof) for the method shown in FIG. 5 in certain example embodiments. Any of the functions performed below by a controller 404 can involve the use of one or more protocols, one or more algorithms, and/or stored data stored in a storage repository. In addition, or in the alternative, any of the functions in the method can be performed by a user (e.g., user 175), which may include an associated user system (e.g., user system 176).

The method shown in FIG. 5 is merely an example that can be performed by using an example system described herein. In other words, systems for securing retention pins in a wellhead assembly can perform other functions using other methods in addition to and/or aside from those shown in FIG. 5. Referring to FIGS. 1 through 5, the method shown in the flowchart 510 of FIG. 5 begins at the START step and proceeds to step 521, where a retention pin (e.g., retention pin 230, retention pin 330) is inserted into a tubing spool channel (e.g., tubing spool channel 251, tubing spool channel 351) of a tubing spool (e.g., tubing spool 250, tubing spool 350).

The retention pin can be inserted into the tubing spool channel using a retention pin driver (e.g., retention pin driver 180), which can be operated by a user (e.g., user 175), a user system (e.g., user system 176), and/or a controller (e.g., controller 104). When the retention pin is inserted, the retention pin can be pushed, rotated, and/or otherwise moved within the tubing spool channel. In certain example embodiments, the retention pin is inserted into the tubing spool channel until the engagement feature (e.g., engagement feature 295, engagement feature 395) is captured by the retention pin receiving feature (e.g., retention pin receiving feature 165, retention pin receiving feature 265, retention pin receiving feature 365) of the tubing spool channel.

In step 522, a determination is made as to whether the retention pin (and more specifically, the engagement feature of the retention pin) is captured by the retention pin receiving feature of the tubing spool channel. The determination can be made using measurements made by one or more sensor devices (e.g., sensor device 185). The determination can be made by a user, a user system, and/or a controller. If the retention pin is captured by the retention pin receiving feature, then the process proceeds to step 524. If the retention pin is not captured by the retention pin receiving feature, then the process reverts to step 521, where the retention pin continues to be inserted into the tubing spool channel.

In step 524, a determination is made as to whether all of the retention pins are captured. As discussed above, a tubing spool can have multiple tubing spool channels, and each tubing spool channel is configured to receive a retention pin. For example, a tubing spool can have 24 tubing spool channels to receive 24 retention pins. In some cases, the retention pins can be inserted simultaneously, as shown in FIGS. 3A through 4C. In other cases, each retention pin is inserted individually, as shown in FIGS. 2A through 2E. The determination as to whether all of the retention pins are captured can be made using measurements made by one or more sensor devices. The determination as to whether all of the retention pins are captured can be made by a user, a user system, and/or a controller. If all of the retention pins are captured, then the process proceeds to step 525. If all of the retention pins are not captured, then the process reverts to step 521 so that the retention pins not yet captured can be inserted into their respective tubing spool channels.

In step 525, a retention pin is moved inward within the tubing spool channel to enter a retention ring channel (e.g., retention ring channel 289, retention ring channel 389) of a retention ring (e.g., retention ring 160, retention ring 260, retention ring 360). The retention pin can be inserted further into the tubing spool channel using a retention pin driver, which can be operated by a user, a user system, and/or a controller. The retention pin driver used in this step 525 can be the same as, or different than, the retention pin driver used in step 521 above. When the retention pin is inserted, the retention pin can be pushed, rotated, and/or otherwise moved within the tubing spool channel. In certain example embodiments, the retention pin is moved inward to such an extent that the engagement feature of the retention pin leaves the tubing spool channel and enters the adjacent retention ring channel until the engagement feature engages (e.g., abuts against) a wall (e.g., the slanted bottom surface 261, the slanted bottom surface 361) of the retention ring channel.

In step 526, a determination is made as to whether the retention pin (and more specifically, the engagement feature of the retention pin) is engaged with the retention ring channel of the retention ring. The determination can be made using measurements made by one or more sensor devices. The determination can be made by a user, a user system, and/or a controller. If the retention pin is engaged with the retention ring channel of the retention ring, then the process proceeds to step 528. If the retention pin is not engaged with the retention ring channel of the retention ring, then the process reverts to step 525, where the retention pin continues to be moved inward within the tubing spool channel.

In step 528, a determination is made as to whether all of the retention pins are engaged. As discussed above, in some cases, the retention pins can be moved inward within the tubing spool channels simultaneously, as shown in FIGS. 3A through 4C. In other cases, each retention pin is moved inward within a tubing spool channel individually, as shown in FIGS. 2A through 2E. The determination as to whether all of the retention pins are engaged can be made using measurements made by one or more sensor devices. The determination as to whether all of the retention pins are engaged can be made by a user, a user system, and/or a controller. If all of the retention pins are engaged, then the process proceeds to the END step. If all of the retention pins are not engaged, then the process reverts to step 525 so that the retention pins not yet engaged can be moved inward within their respective tubing spool channels.

In some cases, example embodiments may be directed to a tubing hanger retention system for a wellhead assembly. In such cases, the engagement feature at the distal end of each retention pin may have a larger diameter relative to a diameter of a remainder of the retention pin. In addition, or in the alternative, in such cases, each retention ring channel may narrow from its distal end inward.

In some cases, example embodiments may be directed to a method for securing retention pins in a wellhead assembly. In such cases, the method may include moving, using a retention pin driver, a plurality of retention pins inward within a plurality of tubing spool channels in a tubing spool of the wellhead assembly. In certain example embodiments, the retention pin driver may engage a proximal end of each of the plurality of retention pins to rotate the retention pin further inward within the channel. In addition, or in the alternative, the retention pin driver may comprise a collar movably disposed around an outer perimeter of the tubing spool, where the collar moves over the proximal end of each of the plurality of retention pins, and where the collar moves the plurality of retention pins further inward within the plurality of tubing spool channels when the collar moves over the proximal end of each of the plurality of retention pins.

In some cases, example embodiments may be directed to a retention ring of a tubing hanger retention system for a wellhead assembly. In such cases, the retention ring may include a body that is configured to be disposed over a top portion of a tubing hanger of the wellhead assembly. Further, the retention ring may include a plurality of retention ring channels positioned toward an outer perimeter of the body, where each of the plurality of retention ring channels is configured to engage an engagement feature disposed at a distal end of one of a plurality of retention pins when the one of the plurality of retention pins is moved inward within a tubing spool channel of a tubing spool of the wellhead assembly.

In some cases, example embodiments may be directed to a retention pin of a tubing hanger retention system for a wellhead assembly. The retention pin may include a body having an elongated shape with an outer perimeter that is configured to be movably disposed within a tubing spool channel of a tubing spool. Further, the retention pin may include a driver enablement feature disposed at a distal end of the body, where the driver enablement feature is configured to engage with a retention pin driver, where the retention pin driver is configured to move the body within the tubing spool channel. In addition, the retention pin may include an engagement feature disposed at a distal end of the body, where the engagement feature is configured to be captured by a retention pin receiving feature disposed in the tubing spool channel, and where the engagement feature is further configured to be engaged by a retention ring channel of a retention ring of the tubing hanger retention system when the body is moved inward within the tubing spool channel.

In some cases, the retention pin may also include an extension disposed toward a proximal end of the body, where the extension has a first diameter that is larger than a second diameter of the body. Further, in some cases, the retention pin may also include a resilient device disposed around the body proximate to the extension, where the resilient device is configured to apply a compressive force against the extension when the body is moved inward within the tubing spool channel.

In some cases, example embodiments may be directed to a tubing spool for a wellhead assembly. The tubing spool may include a body. Further, the tubing spool may include a plurality of tubing spool channels disposed through the body, where each tubing spool channel is configured to receive a retention pin that is movable therein, where each tubing spool channel has a retention pin receiving feature disposed at its distal end, and where the retention pin receiving feature is configured to capture an engagement feature at a distal end of each retention pin as the retention pin moves within the tubing spool channel. In certain example embodiments, each tubing spool channel may further have a recess disposed at its proximal end, and the recess may be configured to receive a resilient device.

Example embodiments can be used to safely and reliably retain the tubing hanger within a wellhead assembly. Example embodiments can use multiple retention pins, a retention ring, and features in the tubing spool channels of the tubing spool. The retention pins are first captured, and subsequently engaged. The retention pins can be engaged simultaneously or a different times. Example embodiments can be used for any of a number of field operations at various pressures, flow rates, and temperatures. Example embodiments can provide a number of benefits. Such benefits can include, but are not limited to, ease of use, reduction in costs, improved safety and reliability, ease of disassembly, reduced need of specialized equipment, configurability, time savings, and compliance with applicable industry standards and regulations.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A tubing hanger retention system for a wellhead assembly, the tubing hanger retention system comprising:

a retention ring that is configured to fit over a top portion of a tubing hanger of the wellhead assembly, wherein the retention ring comprises a plurality of retention ring channels;

a plurality of retention pin receiving features configured to be disposed, at least in part, within a plurality of tubing spool channels of a tubing spool of the wellhead assembly; and a plurality of retention pins configured to be received by the plurality of retention pin receiving features, wherein each retention pin of the plurality of retention pins comprises a distal end, wherein the distal end of each retention pin comprises an engagement feature that is configured to be received by one of the plurality of retention pin receiving features to place the retention pin in a captured state within the tubing spool channel, wherein the engagement feature of each retention pin, after being received by the retention pin receiving feature, is configured to enter into an engaged state with one of the plurality of retention ring channels when the retention pin is moved inward within the tubing spool channel toward the retention ring, and wherein the engagement feature of the retention pin is further configured to remain in the captured state until after the tubing spool is removed from a remainder of the wellhead assembly.

2. The tubing hanger retention system of claim 1, wherein each retention pin of the plurality of retention pins further comprises a body positioned between a proximal end and the distal end, wherein the body has mating threads disposed thereon, and wherein each retention pin is configured to move inward within the tubing spool channel when the retention pin is rotated so that the mating threads engage complementary mating threads disposed on an inner surface of the tubing spool channel.

3. The tubing hanger retention system of claim 2, wherein the proximal end of each retention pin comprises a driver receiving feature that is configured to receive a retention pin driver that rotates the retention pin.

4. The tubing hanger retention system of claim 1, wherein each of the plurality of retention pin receiving features comprises a cavity at a distal end of the tubing spool channel having a larger diameter relative to a diameter of a remainder of the tubing spool channel.

5. The tubing hanger retention system of claim 4, wherein each of the plurality of retention pin receiving features further comprises an adapter that clamps over the engagement feature at the distal end of each retention pin.

6. The tubing hanger retention system of claim 5, wherein each of the plurality of retention ring channels disposed in the retention ring comprises a slanted entry against which the adapter abuts when one of the plurality of retention pins is moved inward within the tubing spool channel.

7. The tubing hanger retention system of claim 4, wherein each of the plurality of retention ring channels disposed in the retention ring comprises a slanted entry against which the distal end of one of the plurality of retention pins abuts when the one of the plurality of retention pins is moved inward within the tubing spool channel.

8. The tubing hanger retention system of claim 1, further comprising:

a collar movably disposed around an outer perimeter of the tubing spool, wherein the collar is configured to move over a proximal end of each retention pin, and wherein the collar is further configured to move the plurality of retention pins inward within the tubing spool channels when the collar moves over the proximal end of each of the plurality of retention pins.

9. The tubing hanger retention system of claim 8, wherein each of the plurality of retention pins further comprises a body positioned between the proximal end and the distal end, wherein the body has a resilient device disposed thereon, and wherein the resilient device is configured to be compressed when the retention pin moves inward within the channel.

10. The tubing hanger retention system of claim 9, wherein the resilient device comprises a conical spring washer.

11. The tubing hanger retention system of claim 8, wherein the collar is threadably coupled to the outer perimeter of the tubing spool.

12. The tubing hanger retention system of claim 8, wherein a distal end of the collar is chamfered, and wherein the distal end of the collar is configured to complement and abut against a chamfer of the proximal end of each of the plurality of retention pins.

13. The tubing hanger retention system of claim 1, wherein each of the plurality of retention pins further comprises a body positioned between the proximal end and the distal end, wherein the body has a sealing member disposed therearound, and wherein the sealing member is configured to abut against an inner surface of the tubing spool channel as the retention pin moves inward within the tubing spool channel.

14. The tubing hanger retention system of claim 13, wherein the sealing member is configured to form an interference fit with the inner surface of the tubing spool channel.

15. The tubing hanger retention system of claim 1, wherein the plurality of retention pins are configured to be removed using a standard landing tool after the tubing spool is removed from the remainder of the wellhead assembly.

16. A wellhead assembly comprising:

a tubing hanger;

a tubing spool coupled to and disposed over the tubing hanger, wherein the tubing spool has a plurality of tubing spool channels disposed therethrough; and a tubing hanger retention system coupled to the tubing spool, wherein the tubing hanger retention system comprises:

a retention ring disposed over a top portion of the tubing hanger, wherein the retention ring comprises a plurality of retention ring channels;

a plurality of retention pin receiving features disposed, at least in part, at a distal end of the tubing spool channels; and a plurality of retention pins received by the plurality of retention pin receiving features, wherein each retention pin of the plurality of retention pins comprises a distal end, wherein the distal end of each retention pin comprises an engagement feature that is received by one of the plurality of retention pin receiving features to place the retention pin in a captured state within the tubing spool channel, wherein the engagement feature of each retention pin, after being received by the retention pin receiving feature, enters into an engaged state when the retention pin is moved inward within the tubing spool channel toward the retention ring channel, and wherein the engagement feature of the retention pin remains in the captured state until after the tubing spool is removed from a remainder of the wellhead assembly.

17. The wellhead assembly of claim 16, wherein the tubing hanger retention system further comprises a collar movably disposed around an outer perimeter of the tubing spool, wherein the collar is configured to move over a proximal end of each of the plurality of retention pins, and wherein the collar is configured to move the plurality of retention pins inward within the tubing spool channels when the collar moves over the proximal end of each of the plurality of retention pins.

18. The wellhead assembly of claim 16, wherein the plurality of retention pins are disposed in the tubing spool channels when the tubing spool is coupled to the wellhead assembly, and wherein the engagement feature of each of the plurality of retention pins is captured by each of the plurality of retention pin receiving features when the tubing spool is coupled to the wellhead assembly.

19. A method for securing retention pins in a wellhead assembly, the method comprising:

moving, using a retention pin driver, a plurality of retention pins inward within a plurality of tubing spool channels in a tubing spool of the wellhead assembly, wherein a distal end of each of the plurality of retention pins comprises an engagement feature that is captured by a retention pin receiving feature disposed in each of the plurality of tubing spool channels, wherein propelling the plurality of retention pins inward engages the engagement feature of each retention pin with one of a plurality of retention ring channels of a retention ring, and wherein the engagement feature of each retention pin remains captured by one of the plurality of retention pin engagement features until after the tubing spool is removed from a remainder of the wellhead assembly.

20. The method of claim 19, further comprising:

inserting the plurality of retention pins into the plurality of tubing spool channels in the tubing spool until the plurality of retention pins are captured by the plurality of retention pin receiving features.

* * * * *